US007296517B2

(12) United States Patent
Nishino et al.

(10) Patent No.: US 7,296,517 B2
(45) Date of Patent: Nov. 20, 2007

(54) ROLL FOR METAL ROLLING, AND SUPPORT FOR LITHOGRAPHIC PRINTING PLATE

(75) Inventors: Atsuo Nishino, Shizuoka (JP); Hirokazu Sawada, Shizuoka (JP); Akio Uesugi, Shizuoka (JP)

(73) Assignee: Fujifilm Corporation, Tokyo (JP)

( * ) Notice: Subject to any disclaimer, the term of this patent is extended or adjusted under 35 U.S.C. 154(b) by 248 days.

(21) Appl. No.: 10/983,027

(22) Filed: Nov. 8, 2004

(65) Prior Publication Data

US 2005/0118452 A1 Jun. 2, 2005

(30) Foreign Application Priority Data

Nov. 11, 2003 (JP) ..... 2003-381358
Jan. 22, 2004 (JP) ..... 2004-014092

(51) Int. Cl.

| | |
|---|---|
| ***B41N 1/08*** | (2006.01) |
| ***B21B 3/00*** | (2006.01) |
| ***B21B 27/02*** | (2006.01) |
| ***C25D 5/36*** | (2006.01) |
| ***C25D 7/00*** | (2006.01) |

(52) U.S. Cl. ..... 101/459; 492/37; 29/895; 72/252.5; 205/210; 205/214; 205/217; 428/687

(58) Field of Classification Search ..... None
See application file for complete search history.

(56) References Cited

U.S. PATENT DOCUMENTS 2,536,912 A * 1/1951 Corbett ..... 204/212
3,743,402 A * 7/1973 Hughes et al. ..... 399/144
6,290,632 B1 * 9/2001 Blake et al. ..... 492/54
2002/0150750 A1 * 10/2002 Bennett et al. ..... 428/327
2005/0159281 A1 * 7/2005 Nishino et al. ..... 492/1

FOREIGN PATENT DOCUMENTS

| | | | |
|---|---|---|---|
| EP | 0 573 988 | A2 | 12/1993 |
| EP | 0 835 764 | A1 | 4/1998 |
| EP | 0 960 743 | A2 | 12/1999 |
| JP | 60-036196 | A | 2/1985 |
| JP | 61-201800 | A | 9/1986 |
| JP | 62-025094 | A | 2/1987 |
| JP | 62-111792 | A | 5/1987 |
| JP | 62-218189 | A | 9/1987 |
| JP | 64-8293 | A | 1/1989 |

(Continued)

OTHER PUBLICATIONS

Translation of JP 1-123094.*

(Continued)

*Primary Examiner*—John J. Zimmerman
(74) *Attorney, Agent, or Firm*—Sughrue Mion, PLLC

(57) ABSTRACT

A roll for metal rolling has a roughened surface formed by an electrolytic treatment in an electrolytic solution while using the roll as an anode. When the roll is used to emboss an aluminum plate, it is possible to obtain an aluminum plate with an uneven structure having regulated positions of levels of peaks and a larger number of the peaks. A presensitized plate formed by use of the aluminum plate as a support has excellent printing performances particularly in the number of printed sheets and sensitivity.

8 Claims, 7 Drawing Sheets

QUANTITY OF PEAKS DEPENDING ON SLICE LEVELS (MEASURED AREA: 400-μm SQUARE)

FOREIGN PATENT DOCUMENTS

| | | | | |
|---|---|---|---|---|
| JP | 1-123094 | A | | 5/1989 |
| JP | 10-259499 | A | | 9/1989 |
| JP | 01-258806 | | * | 10/1989 |
| JP | 02-108403 | | * | 4/1990 |
| JP | 05-311493 | | * | 11/1993 |
| JP | 61-202707 | A | | 9/1996 |
| JP | 11-61354 | A | | 3/1999 |
| JP | 11-61377 | A | | 3/1999 |
| JP | 2001-240994 | A | | 9/2001 |
| JP | 2003-3300 | A | | 1/2003 |
| WO | WO 01/66276 | A1 | | 9/2001 |

OTHER PUBLICATIONS

Translation of JP 64-008293.*
Japanese Abstract No. 01258806, dated Oct. 16, 1989.
Japanese Abstract No. 55161095, dated Dec. 15, 1980.
Japanese Abstract No. 62218189, dated Sep. 25, 1987.
Japanese Abstract No. 02108403, dated Apr. 20, 1990.
Japanese Abstract No. 05311493, dated Nov. 22, 1993.

* cited by examiner

QUANTITY OF PEAKS DEPENDING ON SLICE LEVELS
(MEASURED AREA: 400-μm SQUARE)

ROLL FOR METAL ROLLING, AND SUPPORT FOR LITHOGRAPHIC PRINTING PLATE

This application claims priority on Japanese patent applications No.2003-381358 and No. 2004-014092, the entire contents of which are hereby incorporated by reference. In addition, the entire contents of literatures cited in this specification are incorporated by reference.

BACKGROUND OF THE INVENTION

The present invention relates to a steel roll for metal rolling, more specifically to a roll for forming irregularities on a surface of an aluminum plate by embossing and to a support for a lithographic printing plate obtained by use of the roll.

In a method of manufacturing a support for a lithographic printing plate by forming irregularities on a surface of an aluminum plate by embossing or the like with a steel roll provided with irregularities in advance, a roll for metal rolling formed by shot-blasting the surface of the steel roll has been known (JP 60-36196 A). There are also disclosed other related methods, namely, a rolling method using a steel roll fabricated by honing (forming 500 pieces/mm$^2$ or more irregularities each having an Ra of 0.5 to 1.5 μm and a depth of 0.6 μm or above) while applying a draft of 2% to 20% (JP 62-25094 A), a rolling method using a roll fabricated by chemical etching or honing so as to form 500 pieces/mm$^2$ or more irregularities each having an Ra of 0.5 to 1.5 μm and a depth of 0.6 μm or above while applying a draft of 2% to 20% (JP 62-111792 A), and a rolling method using a roll fabricated by electric discharge machining (forming 500 pieces/mm$^2$ or more irregularities each having an Ra of 0.7 to 1.7 μm and a depth of 0.6 μm or above) while applying a draft of 2% to 20% (JP 62-218189 A).

Concerning the surface of the roll for metal rolling, the conventional techniques have proved that the life duration of the roll is enhanced by regulating positions of peaks of the irregularities formed on the surface of the roll (such positions may be hereinafter referred to as "levels of peaks on the roll surface" when appropriate). However, the conventional roll for rolling an aluminum plate for a support for a lithographic printing plate has been formed with a roughened surface by hitting the surface with abrasives through blasting such as air blasting or shot blasting. Accordingly, the levels of the peaks on the roll surface tended to be uneven. In this way, it has been difficult to obtain the roll surface having desired irregularities sufficient for embossing, and having sufficiently regulated levels of the peaks on the roll surface.

Meanwhile, by use of the rolls according to the conventional techniques, it has been difficult to obtain an aluminum support formed by providing an aluminum plate with irregularities using the roll, which has excellent printing performances particularly in the number of printed sheets, sensitivity, stain resistance, and ink spread resistance when formed into an aluminum support for a lithographic printing plate or more specifically an aluminum support for a CTP plate (which stands for the computer-to-plate technique for manufacturing a lithographic printing plate directly without using a lithographic film by scanning and exposing a presensitized plate to highly convergent radiant rays such as laser beams carrying digitalized image information).

Meanwhile, as a surface roughening method for a surface of a stainless steel plate, a method of obtaining a stainless steel plate having excellent adhesion to various covering materials by performing an alternating current electrolysis in a ferric chloride aqueous solution has been known (JP 10-259499 A).

As another surface roughening method for a surface of a stainless steel plate, a method of obtaining a non-glaring surface-roughened stainless steel plate with small luminosity direction dependency by performing an alternating current electrolysis in a ferric chloride aqueous solution has also been known (JP 11-61354 A).

As still another surface roughening method for a surface of a stainless steel plate, a Cu—Ni alloy covered stainless steel plate obtained by performing Ni plating and Cu plating on a roughened surface formed by performing an alterating current electrolysis in a ferric chloride aqueous solution has also been known (JP 11-61377 A).

In addition, there has also been known a surface roughening method for enhancing adhesion of a steel plate to coating films or adhesives which includes performing an anodic electrolysis for surface roughening by using a steel plate other than stainless steel such as ordinary steel or special steel as an anodic electrode and applying current density in a range of 50 to 150 A/dm$^2$ while generating oxygen bubbles on a steel surface (JP 2003-3300 A).

As a roll for metal rolling for a process used in rolling a steel plate or the like, there has been known a chromium-plated roll for metal rolling formed by performing an electrolytic treatment using a dull finished roll as an anode in an electrolytic solution and thereby increasing the number of peaks on a surface of the roll by 1% to 50% as many as the number of peaks before the electrolysis (JP 64-8293 A).

There have also been known a chromium-plated roll for metal rolling formed by reducing surface roughness in terms of $R_z$ by 5% to 20% as compared to initial roughness before or after chromium plating (JP 61-202707 A), a chromium-plated roll formed by plating chromium using a chromium plating solution including chromic anhydride and sulfuric acid while using the roll as an anode in an etching treatment, which is performed after reducing surface roughness in terms of $R_z$ by 5% to 20% as compared to initial roughness (JP 61-201800 A), and a chromium-plated roll formed by performing a electrolytic treatment in a chromium plating solution while using a bright finish roll as an anode, increasing the number of peaks on a surface of the roll represented by peaks per inch (PPI) by 1.3 to 15 times as many as the initial number of peaks, performing chromium plating while using the roll as a cathode, and then polishing the surface of the plated roll (JP 1-123094 A).

Meanwhile, as a method of manufacturing a chromium-plated roll, there has been known a method including the steps of performing an electrolytic treatment in an electrolytic solution while using a roll base material as an anode, and then performing chromium plating in a chromium plating bath having Fe concentration less than 5 g/dm$^3$, by increasing current density from 0 to 25-35 A/dm$^2$ in a time period of 10 to 30 minutes while using the roll base material as a cathode, maintaining the current density for 2 to 3 minutes, and then reducing and retaining the current density to 20-30 A/dm$^2$ (JP 2001-240994 A), for example.

In these rolls, the surface of the steel roll before the chromium plating may be subjected to an etching treatment so as to enhance adhesion to a chromium-plated layer. However, the roll used for rolling steel plates and the like includes the chromium-plated surface which is configured to roll and finish a cold-rolled steel plate smoothly irrespective of whether the roll is formed as a roll for highly smooth bright steel plates or as a roll for appropriately roughened dull steel plates. Accordingly, an intended shape of a surface of an end product is completely different as compared to a transfer roll for embossing.

In addition, in terms of the rolls for metal rolling, the methods of manufacturing the roll for metal rolling, manufacturing devices, and plating devices, various techniques have been known as disclosed in JP 7-180084 A (a plating device), JP 63-99166 A (a mirror surface polishing device), JP 8-27594 A (a method of manufacturing a steel plate and a chromium-plated roll therefor), JP 5-65686 A (a method of manufacturing a dull roll for metal rolling), JP 2003-171799 A (a batchwise chromium plating method and equipment), JP 3-47985 A (a chromium plating method), JP 2002-47595 A (a chromium plating method and a chromium plating apparatus), and the like.

SUMMARY OF THE INVENTION

The inventors of the present invention have found out that it was possible to obtain a presensitized plate having excellent printing performances particularly in the number of printed sheets and sensitivity by the method of forming a support for a lithographic printing plate which includes rolling an aluminum plate using a roll having regulated peak levels on a surface of a roll provided with irregularities as a steel roll for rolling an aluminum plate for a support for a lithographic printing plate, and further performing a chemical etching treatment, an electrochemical surface roughening treatment, an anodic oxidation treatment, a sealing treatment, a hydrophilic treatment, and the like. In this way, the inventors have invented a roll for embossing an aluminum plate.

Moreover, the inventors have found out that it was possible to obtain the roll having regulated positions of the levels of the peaks on the surface thereof, a lager number of the peaks, and finer pitches among the peaks, by subjecting the steel roll for metal rolling to an electrolytic treatment using an aqueous solution of at least one acid selected from the group consisting of chromic acid, nitric acid, hydrochloric acid, sulfuric acid, and phosphoric acid. The inventors have also found out that it was possible to obtain a presensitized plate having excellent printing performances particularly in the number of printed sheets, sensitivity, stain resistance, and ink spread resistance by the method of forming a support for a lithographic printing plate which includes rolling an aluminum plate using this roll for metal rolling to emboss the aluminum plate, and then performing a chemical etching treatment and an electrochemical surface roughening treatment. In this way, the inventors have invented a roll for metal rolling. Here, in case of performing an electrolytic treatment without using chromic acid, it is possible to reduce chromic acid waste fluids.

Specifically, the present invention will provide the following aspects:

(1) a roll for metal rolling including a roughened surface formed on a surface of a steel roll by an electrolytic treatment in an electrolytic solution while using the roll as an anode, and a chromium-plated layer formed on the roughened surface;

(2) the roll for metal rolling according to the aspect (1), in which the electrolytic solution is an aqueous solution of at least one acid selected from the group consisting of nitric acid, hydrochloric acid, sulfuric acid, and phosphoric acid;

(3) the roll for metal rolling according to the aspect (1), in which the electrolytic solution is an aqueous solution at least including chromic acid;

(4) the roll for metal rolling according to any one of the aspects (1) to (3), in which the surface of the steel roll is subjected to a mirror surface polishing treatment in advance;

(5) the roll for metal rolling according to any one of the aspects (1) to (4), in which the surface of the roll after the electrolytic treatment has an average surface roughness Ra in a range of 0.5 to 2 μm and an average interval of irregularities Sm in a range of 10 to 200 μm;

(6) the roll for metal rolling according to any one of the aspects (1) to (5), in which the average surface roughness Ra on the surface of the steel roll before performing the electrolytic treatment in the electrolytic solution while using the roll as the anode is in a range of 0.01 to 0.3 μm;

(7) the roll for metal rolling according to any one of the aspects (1) to (6), in which the roll for metal rolling is used for embossing an aluminum plate;

(8) a method of manufacturing an aluminum support for a lithographic printing plate including the step of transferring irregularities onto a surface of an aluminum plate by use of the roll for metal rolling according to any one of the aspects (1) to (7); and (9) A support for a lithographic printing plate obtained by subjecting an aluminum plate which have irregularities transferred onto a surface of the aluminum plate by use of the roll for metal rolling according to any one of the aspects (1) to (7), to a chemical etching treatment and an electrochemical surface roughening treatment.

The roll for metal rolling of the present invention includes the roughened surface on the surface of the roll formed by the electrolytic treatment in the electrolytic solution while using the roll as the anode. By embossing the aluminum plate with this roll, it is possible to obtain the aluminum plate with the uneven structure having the regulated positions of the levels of the peaks and a lager number of the peaks. If the lithographic printing plate is formed by using the aluminum plate as the support, the lithographic printing plate has excellent printing performances particularly in the number of printed sheets and sensitivity. Moreover, since the uneven structure on the surface of the roll having fine peak pitches are transferred onto the aluminum plate, it is possible to obtain the presensitized plate having excellent printing performances particularly in the number of printed sheets, sensitivity, stain resistance, and ink spread resistance by forming the lithographic printing plate while using the aluminum plate having this uneven structure as the support.

DETAILED DESCRIPTION OF THE PREFERRED EMBODIMENTS

Figure 1:
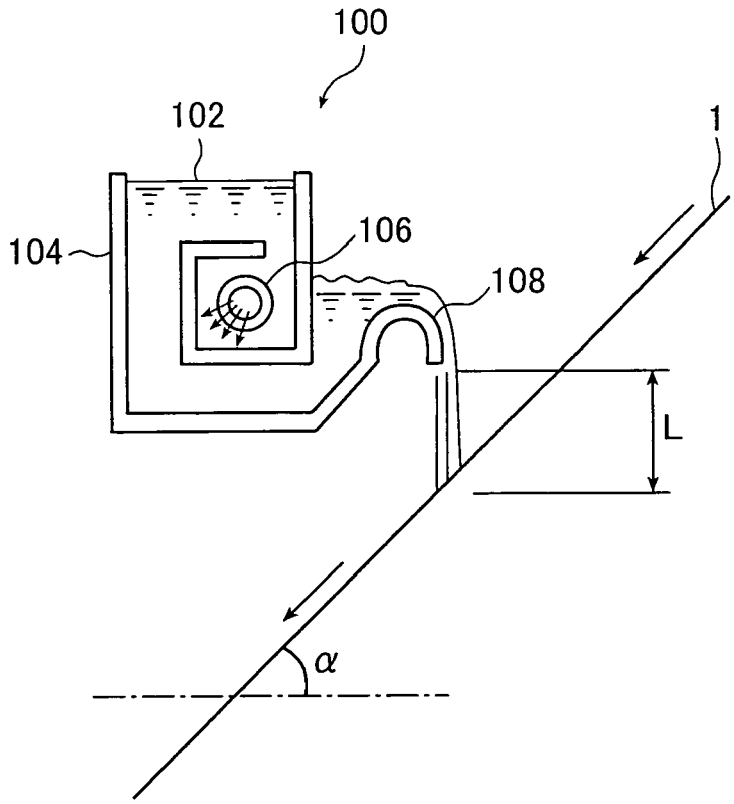
FIG. 1 is a schematic cross-sectional view of an apparatus for performing a water washing treatment with a liquid film of a free-fall curtain shape which is used for a water washing treatment in a method of manufacturing a support for a lithographic printing plate of the present invention.

As a result of extensive studies and researches, the inventors of the present invention have found out that it was possible to obtain a presensitized plate having excellent printing performances particularly in the number of printed sheets and sensitivity by performing an appropriate electrolytic treatment without using blasting to obtain a roll having an uneven structure, that is, a roll having irregularities formed on a surface thereof and forming a support for a lithographic printing plate through rolling of an aluminum plate using the roll. Here, the uneven structure is characterized by having regulated positions of levels of peaks on a surface of the roll, a large number of peaks thereon, and fine pitches among the peaks. In this way, the inventors have invented a roll for metal rolling.

A roll for metal rolling of the present invention can be used for embossing all kinds of metal. Among them, the roll is suitable for embossing an aluminum plate, and particularly preferable for embossing an aluminum plate to be used as a support for a lithographic printing plate. The most preferable use of the roll for metal rolling of the present invention is an application to a roll for embossing an aluminum plate for a support for a CTP lithographic printing plate.

(Roll for Embossing Aluminum Plate)

(1) Material and Pretreatment of Roll

A roll is made of steel, or more particularly forged steel. The material used for the roll in the present invention is not particularly limited, and it is possible to use various kinds of steel such as ordinary steel, tool steel (SKD) generally used for rolls for metal rolling, high-speed steel (SKH), high carbon chromium bearing steel (SUJ), or forged steel containing alloy elements of carbon, chromium, molybdenum and vanadium. It is also possible to use high chromium alloyed cast iron containing chromium in a range of about 10 to 20 wt % to increase the roll life.

The roll for metal rolling is polished in advance by use of a grindstone or the like in order to improve cylindricity and parallelism. When observed microscopically, there are striped irregularities on a surface thereof. It is possible to eliminate the striped irregularities by further subjecting the roll to mirror surface finish, thus obtaining the peaks having the regulated levels easily when the surface of the roll is etched in a subsequent electrolytic treatment. The mirror surface finish may include grinding with a grindstone, a buffing treatment, an electrolytic polishing treatment, and the like. Among these treatments, the buffing treatment is particularly preferred. It is preferable to perform a hardening treatment, such as quenching or a radial nitriding treatment, before performing an electrolytic treatment applying the roll used in the present invention as an anode.

It is preferable to set the average surface roughness Ra of the surface of the roll before performing an electrolytic treatment in an electrolytic solution while using the roll as an anode in a range of 0.01 to 0.3 μm and a maximum level Ry in a range of 0.01 to 3 μm. It is more preferable to set the Ra in a range of 0.15 to 0.25 μm and the Ry in a range of 0.05 to 2 μm. It is difficult to obtain a surface having the Ra less than 0.01 μm at low costs. When the Ra exceeds 0.3 μm, the levels of the peaks on the surface of the roll are not regulated when the roll is subjected to the electrolytic treatment. Accordingly, the roll life may be shortened. It is difficult to obtain a surface having the Ry less than 0.01 μm at low costs. When the Ry exceeds 3 μm, the levels of the peaks on the surface of the roll are not regulated when the roll is subjected to the electrolytic treatment. Accordingly, the roll life may be shortened.

(2) Electrolytic Treatment

The surface of the roll is roughened by performing an electrolytic treatment in an electrolytic solution while using the roll as an anode. As the electrolytic solution, it is possible to use any kinds of aqueous solution of acids generally applied to surface roughening treatments on metal, such as nitric acid, hydrochloric acid, sulfuric acid, chromic acid, phosphoric acid, and mixtures thereof.

The surface of the roll can be roughened by performing an electrolytic treatment in an aqueous solution of at least one acid selected from the group consisting of nitric acid, hydrochloric acid, sulfuric acid, and phosphoric acid, while using the roll as the anode. The electrolytic solution is the aqueous solution of at least one acid selected from the group consisting of nitric acid, hydrochloric acid, sulfuric acid, and the phosphoric acid, and may be a bath not containing chromic acid. The use of chromic acid is often avoided because chromic acid imposes high burdens on the environment occasionally. By performing an electrolysis using the aqueous solution of at least one strong acid selected from the group consisting of nitric acid, hydrochloric acid, sulfuric acid, and phosphoric acid, it is possible to obtain finer peaks on the roughened surface. It is preferable to form a support for a lithographic printing plate by rolling an aluminum plate using this roll, because it is possible to obtain a presensitized plate having excellent printing performances particularly in the number of printed sheets, sensitivity, stain resistance, and ink spread resistance.

It is preferable that this electrolytic solution contain metal ions which are contained in the roll to be subjected to surface roughening. When necessary, it is preferable to add the metal ions contained in the roll in the form of a relevant metal salt.

As for concrete conditions of the electrolytic treatment, although it is possible to use both an alternating current and a direct current as a power source waveform, it is particularly preferable to use the direct current.

When using the alternating current, it is possible to use any of a sinusoidal wave, a rectangular wave, a trapezoidal wave, and a triangular wave. A frequency of such a wave can be selected from a range of 0.1 to 120 Hz. Moreover, a ratio $Q_R/Q_F$ between a total quantity of electricity $Q_F$ applied when performing an anodic reaction and a total quantity of electricity $Q_R$ applied when performing a cathodic reaction can be selected from a range of 0.1 to 1.

When using the direct current, it is possible to use any of a smooth direct current, a direct current subjected to three-phase full-wave rectification, a direct current subjected to single-phase full-wave rectification, and the like. In any case, it is particularly preferable to use a direct current having a ripple rate equal to or below 5%.

The current density is set preferably in a range of 20 to 150 A/dm$^2$, or more preferably in a range of 30 to 100 A/dm$^2$. It is difficult to achieve uniform surface roughening if the current density is below 20 A/dm$^2$, and power costs are increased because of a high electrolytic voltage if the current density is above 150 A/dm$^2$.

When performing the surface roughening treatment in the electrolytic solution of the strong acid while using the roll as the anode, the quantity of electricity is set preferably in a range of 500 to 30000 C/dm$^2$, or more preferably in a range of 800 to 15000 C/dm$^2$. Sufficient surface roughness cannot be obtained if the quantity of electricity is below 500 C/dm$^2$, and the surface tends to be uneven if the quantity of electricity is above 30000 C/dm$^2$.

The quantity of electricity for obtaining the same Ra varies depending on the material of the roll, conditions for a thermal treatment of the roll, the type of the electrolytic solution used therein, and conditions for the electrolysis. Accordingly, it is necessary to adjust the quantity of electricity while considering these various conditions.

Solution temperature is set preferably in a range of 20° C. to 60° C., or more preferably in a range of 30° C. to 55° C.

Temperature locality (uneven distribution) may be caused by heat generation attributable to the Joule heat generated in the course of the electrolysis if the solution temperature is below 20° C. When the temperature locality is present, an electric current tends to flow more on a high-temperature portion, and resultantly the surface of the roll is not roughened uniformly.

On the contrary, water evaporation is excessive if the solution temperature is above 60° C. Such high temperature is not preferable because frequent concentration management or liquid amount management is required.

The concentration of the electrolytic solution will be adjusted as described below.

1) Electrolytic Solution Containing Sulfuric Acid as Main Ingredient

The sulfuric acid concentration is set preferably in a range of 100 to 500 g/L, or more preferably in a range of 200 to 400 g/L.

It is difficult to achieve uniform surface roughening if the concentration is below 100 g/L. On the contrary, if the concentration is above 500 g/L, it is difficult to control the shape of the surface due to an increase in chemical solubility of the solution attributable to high corrosiveness.

In an aqueous solution containing sulfuric acid as the main ingredient, it is preferable to dissolve metal that liquates out of the roll beforehand from the viewpoint of reproducibly obtaining the shape of the roughened surface. In particular, it is preferable to add iron ions in the form of iron sulfate and to set the iron ion concentration in a range of 0.5 to 5 g/L.

Hydroxides of substances such as dissolved iron may be formed on a surface of a counter electrode to the roll, and such formation of hydroxides may cause an increase in the electrolytic voltage. Accordingly, it is particularly preferable to add sodium sulfate to the aqueous solution containing sulfuric acid as the main ingredient in a range of 10 to 100 g/L.

2) Electrolytic Solution Containing Nitric Acid as Main Ingredient

The nitric acid concentration is set preferably in a range of 50 to 200 g/L, or more preferably in a range of 80 to 150 g/L. It is difficult to achieve uniform surface roughening if the concentration is below 50 g/L. On the contrary, if the concentration is above 200 g/L, it is difficult to control the shape of the surface due to an increase in chemical solubility of the solution attributable to high corrosiveness.

In an aqueous solution containing nitric acid as the main ingredient, it is preferable to dissolve metal that liquates out of the roll beforehand from the viewpoint of reproducibly obtaining the shape of the roughened surface. In particular, it is preferable to add iron ions in the form of iron nitrate and to set the iron ion concentration in a range of 0.5 to 5 g/L.

Hydroxides of substances such as dissolved iron may be formed on the surface of the counter electrode to the roll, and such formation of hydroxides may cause an increase in the electrolytic voltage. Accordingly, it is particularly preferable to add sodium nitrate to the aqueous solution containing nitric acid as the main ingredient in a range of 10 to 100 g/L.

3) Electrolytic Solution Containing Hydrochloric Acid as Main Ingredient

The hydrochloric acid concentration is set preferably in a range of 1 to 150 g/L, or more preferably in a range of 30 to 80 g/L. It is difficult to achieve uniform surface roughening if the concentration is below 1 g/L. On the contrary, if the concentration is above 150 g/L, it is difficult to control the shape of the surface due to an increase in chemical solubility of the solution attributable to high corrosiveness.

In an aqueous solution containing hydrochloric acid as the main ingredient, it is preferable to dissolve metal that liquates out of the roll beforehand from the viewpoint of reproducibly obtaining the shape of the roughened surface. Upon preparation of a bath of the electrolytic solution containing hydrochloric acid as the main ingredient, it is particularly preferable to set the $Fe^{3+}$ ion concentration in a range of 10 to 150 g/L by use of ferric chloride.

Hydroxides of substances such as dissolved iron may be formed on the surface of the counter electrode to the roll, and such formation of hydroxides may cause an increase in the electrolytic voltage. Accordingly, it is particularly preferable to add sodium chloride to the aqueous solution containing hydrochloric acid as the main ingredient in a range of 10 to 100 g/L.

4) Electrolytic Solution Containing Phosphoric Acid as Main Ingredient

The phosphoric acid concentration is set preferably in a range of 1 to 500 g/L, or more preferably in a range of 30 to 400 g/L.

It is difficult to achieve uniform surface roughening if the concentration is below 1 g/L. On the contrary, if the concentration is above 500 g/L, it is difficult to control the shape of the surface due to an increase in chemical solubility of the solution attributable to high corrosiveness.

It is possible to use a mixture of phosphoric acid with other acids. For example, it is possible to use a mixture of phosphoric acid and sulfuric acid or a mixture of phosphoric acid, sulfuric acid and nitric acid.

In an aqueous solution containing phosphoric acid as the main ingredient, it is preferable to dissolve metal that liquates out of the roll beforehand from the viewpoint of reproducibly obtaining the shape of the roughened surface.

In particular, it is preferable to add iron ions in the form of iron phosphate and to set the iron ion concentration in a range of 0.5 to 150 g/L.

Hydroxides of substances such as dissolved iron may be formed on the surface of the counter electrode to the roll, and such formation of hydroxides may cause an increase in the electrolytic voltage. Accordingly, it is particularly preferable to add sodium phosphate to the aqueous solution containing phosphoric acid as the main ingredient in a range of 10 to 100 g/L.

5) Electrolytic solution using a mixture of acids The above-described nitric acid, hydrochloric acid, sulfuric acid, and phosphoric acid can be used either independently or in a mixture of two or more acids.

6) Electrolytic Solution Containing Chromic Acid as Main Ingredient

A bath containing chromic anhydride (chromium trioxide) with addition of a small amount of sulfuric acid, a fluoride or a silicofluoride as a catalyst is used. It is possible to use an electrolytic solution as used in a chromium plating bath to be described later.

As a concrete bath composition, it is possible to cite a mixture of chromic acid in a range of 150 to 400 g/L or more preferably in a range of 200 to 350 g/L, sulfuric acid in a range of 1 to 5 g/L or more preferably in a range of 2 to 4 g/L, and iron equal to or below 7 g/L or more preferably in a range of 0.01 to 5 g/L, for example. It is possible to cite a Sargent's bath containing chromic anhydride and sulfuric acid, for example, which is generally known as a hard chromium plating bath. When performing the electrolytic treatment in an anode electrolytic bath similar to a plating bath for chromium plating of the roll for metal rolling to be described later, it is possible to use the same bath in the electrolytic treatment as well as in the plating process.

As a material for the counter electrode to the roll used as the anode, it is possible to use iron, aluminum, lead, a lead alloy, carbon, and the like. However, carbon is particularly preferred.

To use the roll for metal rolling to roll an aluminum plate for an aluminum support for a lithographic printing plate, it is preferable to set the average surface roughness Ra on the surface of the roll after the electrolytic treatment in a range of 0.5 to 2.0 μm and to set the average interval of irregularities Sm in a range of 10 to 200 μm.

If the Ra is below 0.5 μm, it is not possible to transfer sufficient irregularities onto the aluminum plate. Accordingly, when the aluminum support for a lithographic printing plate is manufactured by use of this aluminum plate, a lithographic printing plate will lack shininess. Levels of peaks are not regulated when the surface of the roll having the Ra above 2.0 μm is formed by the electrolytic treatment. Accordingly, when the aluminum support for a lithographic printing plate is manufactured by use of this aluminum plate, a lithographic printing plate will lack sensitivity. It is difficult to obtain the sufficient Ra on the aluminum plate after rolling by use of the roll having the Sm below 10 μm. On the contrary, when the Sm is above 200 μm, it is not possible to obtain the sufficient number of printed sheets when manufactured into the aluminum support for a lithographic printing plate.

The maximum level Ry on the surface of the roll after the electrolytic treatment is set preferably in a range of 5 to 25 μm (more preferably in a range of 7 to 15 μm), and average inclination pitch Δa is set preferably in a range of 5 to 25 degrees (more preferably in a range of 8 to 20 degrees).

Here, the Ra, the Ry ($R_{max}$), the Sm ($R_{sm}$), and the Δa can be measured in accordance with the ISO 4287. Two-dimensional roughness measurement is conducted by use of a probe-type roughness measuring instrument (such as "surfcom 575" made by Tokyo Seimitsu Co. Ltd.), and the arithmetic average roughness Ra is measured five times and an average value of the measured values is defined as the average roughness. The maximum level Ry concerning a standard length, the average interval of irregularities (an average value within the standard length) Sm, and the average inclination pitch Δa are measured similarly.

By regulating the levels of the peaks, it is possible to increase the life of the roll for metal rolling. Further, when the roll is used for providing the irregularities in the process of cold rolling the aluminum support for use in the lithographic printing plate, depths of dents of the aluminum plate provided with the irregularities become uniform and pitches of the dents become finer, whereby formation of locally deep dents are avoided. Accordingly, the lithographic printing plate using this aluminum plate has good sensitivity. Such an effect is significant when manufacturing a CTP lithographic printing plate.

(3) Chromium Plating

As a chromium plating bath, a bath containing chromic anhydride (chromium trioxide) with addition of a small amount of sulfuric acid, a fluoride or a silicofluoride as a catalyst is used. As for the anode, a lead alloy is cited as an insoluble anode, for example. Trivalent chromic acid generated in a plating solution due to an electrolytic reaction is contained in the plating solution. An optimum value exists for the trivalent chromic acid, and the concentration thereof is set preferably in a range of 1 to 7 g/L. Current efficiency is degraded when the trivalent chromium is either too high or too low. Although the trivalent chromium is generated in a chromium plating electrolytic reaction, a reducer such as glucose, tartaric acid, chromium carbonate, or oxalic acid is often added to generate the trivalent chromium. Among them, chromium carbonate is particularly preferred as the reducer.

As a concrete bath composition, it is possible to cite the chromic acid concentration in a range of 150 to 400 g/L or more preferably in a range of 200 to 350 g/L, the sulfuric acid concentration in a range of 1 to 5 g/L or more preferably in a range of 2 to 4 g/L, and the iron concentration equal to or below 7 g/L or more preferably in a range of 0.01 to 5 g/L, for example. It is most preferable to use a so-called Sargent's bath containing chromic anhydride and sulfuric acid, for example, which is generally used as a hard chromium plating bath.

It is possible to use the same bath for the bath to perform the electrolytic treatment in the electrolytic solution containing chromic acid as the main ingredient while using the roll as the anode and for the bath to perform the hard chromium plating. However, iron liquates out during the electrolytic treatment in the electrolytic solution while using the roll as the anode, and such an increase in iron complicates fine plating. Accordingly, it is preferable to use mutually different baths. When using different baths, the activity of the surface of the roll is degraded because the roll travels in the air, and such degradation in activity complicates fine plating. Therefore, it is preferable to perform a reverse electrolytic treatment (an etching treatment) by applying current density in a range of 20 to 80 A/dm$^2$ for 10 to 60 seconds immediately before the chromium plating in order to activate the surface again.

As for the plating conditions, the solution temperature is set preferably in a range of 20° C. to 70° C. or more preferably in a range of 40° C. to 60° C., and the current density is set preferably in a range of 20 to 80 A/dm$^2$ or more preferably in a range of 25 to 60 A/dm$^2$. It is possible to use either a direct current or an alternating current as the power waveform. However, it is preferable to use the direct current. The direct current preferably contains a ripple component of not more than 5%. Concerning the electric current, it is preferable to raise the current from low current density to high current density gradually in a period from 1 to 100 seconds and to retain the constant current thereafter. According to this method, it is easier to achieve uniform plating.

The thickness of the hard chromium plating is set preferably in a range of 1 to 15 μm or most preferably in a range of 3 to 9 μm. Sufficient abrasion resistance cannot be achieved if the thickness is below 1 μm. If the thickness is above 15 μm, the surface is smoothened by plating. In this case, it is not possible to exert the effect of the irregularities provided by the electrolytic treatment while using the roll as the anode.

It is preferable to set the average surface roughness Ra on the surface of the roll after the hard chromium plating treatment in a range of 0.5 to 2.0 μm and to set the Sm in a range of 10 to 200 μm. If the Ra is below 0.5 μm, it is not possible to transfer the sufficient irregularities. Accordingly, when the aluminum support for a lithographic printing plate is manufactured by use of this aluminum plate, a lithographic printing plate will lack shininess. The levels of peaks are not regulated when the surface of the roll having the Ra above 2.0 μm is formed by the electrolytic treatment. Accordingly, when the aluminum support for a lithographic printing plate is manufactured by use of this aluminum plate, a lithographic printing plate will lack sensitivity. It is difficult to obtain the sufficient Ra on the aluminum plate after rolling by use of the roll having the Sm below 10 μm. On the contrary, when the Sm is above 200 μm, it is not possible to obtain the sufficient number of printed sheets when manufactured into the aluminum support for a lithographic printing plate.

The Ry on the surface of the roll after the hard chromium plating treatment is set preferably in a range of 5 to 25 μm (more preferably in a range of 7 to 15 μm), and the Δa is set preferably in a range of 5 to 25degrees (more preferably in a range of 8 to 20 degrees).

Concerning the peaks after the electrolytic treatment on the surface of the roll while using the roll as the anode or after the hard chromium plating in the present invention, it is preferable that the peaks be uniformly dispersed when projecting the surface from immediately above in a planar shape, and that the number of the peaks be in a range of 10 to 1000 pieces in each 400-μm square area or more preferably 50 to 500 pieces in the unit area.

In light of the abrasion resistance, it is preferable to set the hardness of the surface of the roll in a range of 700 Hv to 1000 Hv. Moreover, after the hard chromium plating, it is preferable to set the hardness in a range of 800 Hv to 1200 Hv.

(4) Preferred Use of Roll for Metal Rolling

It is preferable to use the roll for metal rolling of the present invention to provide irregularities onto surfaces of aluminum plates, or more specifically to provide irregularities onto surfaces of aluminum plates for forming aluminum plates for lithographic printing plates. Among them, it is most preferable to use the roll to provide irregularities onto a surface of an aluminum plate for forming an aluminum plate for a CTP lithographic printing plate. As compared to conventional surface roughening treatments using only abrasives and brushes, according to the present invention, it is possible to suppress generation of deep and steep dents and thereby to form a support having favorable sensitivity.

When embossing the aluminum plate for use in the aluminum support for a lithographic printing plate while using the roll of the present invention, the draft is set preferably in a range of 0.5% to 20%, more preferably in a range of 1% to 8%, or most preferably in a range of 1% to 5%. It is also possible to perform such rolling works for the pattern transfer through 1 to 3 paths.

Parameters for the shape of the surface of the aluminum plate formed with the uneven pattern by the roll for metal rolling according to the present invention are preferably set so that the Ra is in a range of 0.4 to 1.0 μm, the Sm in a range of 30 to 150 μm, the Ry in a range of 1 to 10 μm, and the Δa in a range of 1 to 10 degrees, respectively in accordance with the JIS definitions.

(Aluminum Support)

(Aluminum Plate (Rolled Aluminum))

The aluminum plate used as a substrate of a support for a lithographic printing plate according to the present invention is made of metal containing dimensionally stable aluminum as the main ingredient, namely, aluminum or an aluminum alloy. In addition to a pure aluminum plate, it is also possible to use an alloy plate containing aluminum as the main ingredient and small amounts of foreign elements, and a plastic film or a sheet of paper on which aluminum or the aluminum alloy is laminated or vapor-deposited. Furthermore, it is also possible to use a compound sheet as disclosed in JP 48-18327 B formed by attaching an aluminum sheet onto a polyethylene terephthalate film.

In the following description, the above-mentioned various substrates made of aluminum or aluminum alloys, and various substrates including layers made of aluminum or aluminum alloys will be hereinafter referred to as the aluminum plates collectively. The allowable foreign elements in the aluminum alloys include silicon, iron, manganese, copper, magnesium, chromium, zinc, bismuth, nickel, titanium, and the like. The content of the foreign elements in the alloys should be set equal to or below 10 wt %.

In the present invention, it is preferable to use the pure aluminum plate. However, since it is difficult to manufacture completely pure aluminum in light of the smelting technology, an aluminum plate used in the present invention may contain small amounts of the foreign elements. Compositions of the aluminum plates used in the present invention are not particularly limited. For example, it is possible to use publicly known aluminum alloy plates designated as JIS A1050, JIS A1100, JIS A3005, International registered alloy 3103A, and the like as appropriate.

The thickness of the aluminum plate used in the present invention is set preferably in a range of 0.1 to 0.6 mm, more preferably in a range of 0.15 to 0.4 mm, or most preferably in a range of 0.2 to 0.3 mm. The thickness can be changed as appropriate depending on the size of a printing machine, the size of the printing plate, user's requests, and the like.

When forming the aluminum alloy into a plate member, it is possible to adopt the following method, for example. Firstly, aluminum alloy molten metal adjusted to given contents of alloy components is subjected to a cleaning treatment and then cast in accordance with a conventional method. As for the cleaning treatment, in order to remove unnecessary gas in the molten metal such as hydrogen, a flux treatment, a degasification treatment using argon gas, chlorine gas or the like, a filtering treatment using any of a so-called rigid media filter such as a ceramic tube filter or a ceramic foam filter, a filter applying alumina flakes or alumina balls as a filtering element, a glass cloth filter, and the like, or a combined treatment of the degasification treatment and the filtering treatment is performed.

It is preferable that these cleaning treatments be carried out to prevent the occurrence of defects attributable to foreign substance in the molten metal such as non-metal intermediates or oxides, and defects attributable to gas dissolved in the molten metal. Techniques related to filtering of molten metal are disclosed in various publications, namely, JP 6-57432 A, JP 3-162530 A, JP 5-140659 A, JP 4-231425 A, JP 4-276031 A, JP 5-311261 A, JP 6-136466 A, and the like. Meanwhile, techniques related to degasification of molten metal are disclosed in various publications, namely, JP 5-51659 A, JP 5-49148 U, and the like. The applicant of the present invention has also proposed a technique concerning degasification of molten metal in JP 7-40017 A.

Subsequently, casting is performed by use of the molten metal subjected to the cleaning treatment as described above. Casting methods include a method using a fixed mold as typified by the DC casting method, and a method using a mobile mold as typified by the continuous casting method.

In the DC casting method, solidification takes place at a cooling rate in a range of 0.5 to 30° C./sec. When the cooling rate is below 0.5° C./sec, a large amount of coarse intermetallic compounds are often formed. When the DC casting is performed, an ingot having a plate thickness of 300 to 800 mm can be fabricated. The ingot is treated according to a conventional method and is subjected to facing as appropriate to cut the surface layer usually in a range of 1 to 30 mm or preferably 1 to 10 mm. Before or after the facing, the ingot is subjected to a homogenization treatment as appropriate. When the homogenization treatment is performed, a heat treatment is performed at 450 to 620° C. for 1 to 48 hours to prevent coarse intermetallic compounds from being produced. Sufficient effect of the homogenization treatment is often not attained when the heat treatment time is shorter than one hour. In execution of the homogenization treatment is advantageous in the cost reduction.

Thereafter, hot rolling and cold rolling are performed to obtain an aluminum flat-rolled plate. The initial temperature of the hot rolling is appropriately in a range of 350 to 500° C. An intermediate annealing treatment may be performed before, after, or in mid-course of the hot rolling. Conditions of the intermediate annealing treatment may be heating for 2 to 20 hours at 280° C. to 600° C. or preferably for 2 to 10 hours at 350° C. to 500° C. by use of a batch annealing furnace, or heating for 6 minutes or less at 400° C. to 600° C. or preferably for 2 minutes or less at 450° C. to 550° C. by use of a continuous annealing furnace. It is also possible to form fine crystalline structures by heating at a temperature rising rate of 10 to 200° C./sec with the continuous annealing furnace.

The aluminum plate finished into the given thickness as in the range of 0.1 to 0.5 mm by the above-described processes may be further treated to improve the flatness by use of a reformation apparatus such as roller leveler or a tension leveler. Although it is possible to perform the improvement in flatness after cutting the aluminum plate into sheets, it is preferable to perform the improvement in flatness in a state of a continuous coil to enhance productivity. It is also possible to feed the aluminum plate into a slitter line so as to form the aluminum plate into a given plate width. Moreover, it is possible to provide thin oil films on surfaces of the aluminum plates to prevent occurrence of scratches due to friction between the aluminum plates. Such oil films may be volatile or nonvolatile as appropriate.

Industrially practiced continuous casting methods include methods using cooling rolls as typified by the twin roll method (the Hunter method) and the 3C method, and methods using cooling belts or cooling blocks as typified by the twin belt method (the Hazelett method) and the Alusuisse Caster II. When using the continuous casting method, solidification takes place at a cooling rate in a range of 100 to 1000° C./sec. In general, the continuous casting method has a higher cooling rate as compared to the DC casting method, and therefore has a characteristic that the continuous casting method can increase solid solubility of alloy components relative to an aluminum matrix. Concerning the continuous casting method, the applicant of the present invention has proposed techniques as disclosed in various publications, namely, JP 3-79798 A, JP 5-201166 A, JP 5-156414 A, JP 6-262203 A, JP 6-122949 A, JP 6-210406 A, JP 6-26308A, and the like.

In the case of performing the continuous casting, when the method using cooling rolls such as the Hunter method is applied, for example, various advantages are obtained such as a possibility to cast a plate in a plate thickness of 1 to 10 mm directly and continuously and a possibility to omit a hot rolling process. In the meantime, when the method using cooling belts such as the Hazelett method is applied, it is possible to cast a plate in a plate thickness of 10 to 50 mm. Generally, it is possible to obtain a plate in a plate thickness of 1 to 10 mm by arranging a hot rolling mill immediately after casting to perform rolling continuously.

These continuously cast flat-rolled plates are finished into a given thickness, such as a plate thickness of 0.1 to 0.5 mm, through processes such as cold rolling, intermediate annealing, flatness improvement and slitting. Concerning the conditions for intermediate annealing and the conditions for cold rolling when using the continuous casting method, the applicant of the present invention has proposed techniques as disclosed in various publications, namely, JP 6-220593 A, JP 6-210308 A, JP 7-54111 A, and JP 8-92709 A.

It is preferable that the aluminum plate used in the present invention be well-tempered in accordance with H18 as defined in JIS.

The aluminum plate manufactured as described above is expected to have various characteristics as follows.

Concerning the strength of the aluminum plate, in order to obtain flexure strength required for the support for a lithographic printing plate, it is preferable to set the 0.2% proof stress equal to or above 120 MPa. Moreover, in order to obtain a certain degree of flexure strength in case of performing a burning treatment as well, it is preferable to set the 0.2% proof stress equal to or above 80 MPa after heating at 270° C. for 3 to 10 minutes. In this case, it is more preferable to set the 0.2% proof stress equal to or above 100 MPa. In particular, it is possible to adopt an aluminum material having additional Mg or Mn to seek the flexure strength in the aluminum plate. However, an increase in the flexure strength causes degradation in fitness to a plate cylinder of a printing machine. Accordingly, appropriate material quality and amounts of addition of minor components are selected depending on the usage. In this regard, the applicant of the present invention has disclosed the related techniques in JP 7-126820 A, JP 62-140894 A, and the like.

Meanwhile, concerning the aluminum plate, it is preferable to set the tensile strength at 160±15 N/mm$^2$, the 0.2% proof stress at 140±15 MPa, and stretch as defined in JIS Z2241 and Z2201 in a range of 1% to 10%.

It is preferable that a crystal structure of the aluminum plate on the surface be not too large because the crystal structure on the surface of the aluminum plate may cause defects in the surface quality when performing a chemical surface roughening treatment or an electrochemical surface roughening treatment. Concerning the crystal structure on the surface of the aluminum plate, the width is set preferably equal to or below 200 μm, more preferably equal to or below 100 μm, or even more preferably equal to or below 50 μm. Meanwhile, the length of the crystal structure is set preferably equal to or below 5000 μm, more preferably equal to or below 1000 μm, or even more preferably equal to or below 500 μm. In this regard, the applicant of the present invention has disclosed the related techniques in JP 6-218495 A, JP 7-39906 A, JP 7-124609 A, and the like.

It is preferable that distribution of the alloy components of the aluminum plate be not too uneven because the uneven distribution of the alloy components on the surface of the aluminum plate may cause defects in the surface quality when performing a chemical surface roughening treatment or an electrochemical surface roughening treatment. In this regard, the applicant of the present invention has disclosed the related techniques in JP 6-48058 A, JP 5-301478 A, JP 7-132689 A, and the like.

In the present invention, the above-described aluminum plate is provided with the irregularities in its final rolling process and the like by means of press rolling, transfer or the like using the roll for metal rolling of the present invention.

Among them, it is preferable to apply a method of forming the uneven pattern on the surface of the aluminum plate by pressing the surface provided with the irregularities onto the aluminum plate and thereby transferring the uneven patterns simultaneously with cold rolling for adjusting the aluminum plate to a final thickness or finish cold rolling for finishing the shape of the surface after adjusting the aluminum plate to the final thickness. It is possible to reduce costs drastically by simplifying the process while transferring the irregularities onto the surface of the aluminum plate simultaneously with the final cold rolling. To be more precise, it is possible to apply the method disclosed in JP 6-262203 A.

By use of the aluminum plate having the uneven pattern on the surface, it is possible to obtain the uneven pattern with uniform average pitches and depths as compared to an uneven pattern formed by use of brushes and abrasives. Accordingly, it is possible to improve the stain resistance. Moreover, it is possible to reduce energy consumption in subsequent alkaline etching treatment and surface roughening treatment and to facilitate control of an amount of a fountain solution on a printing machine (excellent in shininess). Furthermore, it is possible to reduce an etching amount to about 10 g/m$^2$ or less in a first alkaline etching treatment to be described later, and thereby to reduce the costs. In addition, a surface area of the obtained support for a lithographic printing plate is increased by use of the aluminum plate having the uneven pattern. Accordingly, the support for a lithographic printing plate has excellent press life.

It is particularly preferable to perform the transfer in a final cold rolling process of a normal aluminum plate.

Moreover, it is preferable to form the irregularities on both surfaces of the aluminum plate by the transfer. In this way, the stretch ratios on the top surface and the bottom surface of the aluminum plate can be adjusted to approximately the same degree. Accordingly, it is possible to obtain the aluminum plate excellent in flatness.

The aluminum plates used in the present invention are either continuous belt-shaped sheet materials or plate materials. In other words, it is possible to use aluminum webs or leaf plates cut into the size corresponding to the presensitized plates shipped as the products.

Scratches on the surface of the aluminum plate may cause defects when the plate is formed into the support for a lithographic printing plate. Accordingly, it is necessary to suppress generation of scratches to the least possible degree at the stage prior to a surface treatment process for forming the support for a lithographic printing plate. In this regard, it is preferable to apply appropriate packaging which is stable and scratch-proof during transportation.

As the packaging in case of the aluminum web, for example, a hard board and a felt sheet are laid over an iron palette, and donut plates made of a cardboard are attached to both ends of the product. Then, the entire product is wrapped with a polyethylene tube, and a donut made of wood is inserted in the internal circle of a coil. Subsequently, another felt sheet is attached to the outer periphery of the coil, then the product is bound by iron hoops and indications are put on the outer periphery thereof. Here, it is possible to use a polyethylene film as a wrapping material, and to use needle felt and hard boards as cushioning materials. Although there are various other packaging methods, the method is not limited to the foregoing as long as it is possible to transport the aluminum plate stably and without causing scratches thereon.

(Surface Roughening of Aluminum Plate after Transfer of Irregularities)

The aluminum plate after transfer of the irregularities is further subjected to appropriate surface roughening treatments (an alkaline etching treatment, a desmutting treatment, an electrochemical surface roughening treatment, an anodic oxidation treatment, a hydrophilic treatment, and a sealing treatment) to manufacture the aluminum support for a lithographic printing plate. Then, the aluminum support is coated with a recording layer such as a photosensitive layer to manufacture the presensitized plate.

Preferable aspects of the surface treatments are as follows.

1) Surface Treatment Aspect 1

A method of subjecting the aluminum plate sequentially to:

(1) a chemical etching treatment;
(2) an electrochemical surface roughening treatment in an aqueous solution containing nitric acid as the main ingredient;
(3) another chemical etching treatment;
(4) an electrochemical surface roughening treatment in an aqueous solution containing hydrochloric acid as the main ingredient;
(5) another chemical etching treatment; and
(6) an anodic oxidation treatment.

2) Surface Treatment Aspect 2

A method of subjecting the aluminum plate sequentially to:

(1) a chemical etching treatment;
(2) an electrochemical surface roughening treatment in an aqueous solution containing nitric acid as the main ingredient;
(3) another chemical etching treatment; and
(4) an anodic oxidation treatment.

1) Surface Treatment Aspect 3

A method of subjecting the aluminum plate sequentially to:

(1) a chemical etching treatment;
(2) an electrochemical surface roughening treatment in an aqueous solution containing hydrochloric acid as the main ingredient;
(3) another chemical etching; and (4) an anodic oxidation treatment.

4) Surface Treatment Aspect 4

A method of subjecting the aluminum plate sequentially to:

(1) a chemical etching treatment;
(2) an electrochemical surface roughening treatment in an aqueous solution containing hydrochloric acid as the main ingredient;
(3) another chemical etching treatment;
(4) an electrochemical surface roughening treatment in an aqueous solution containing nitric acid as the main ingredient;
(5) another chemical etching treatment; and
(6) an anodic oxidation treatment.

5) Surface Treatment Aspect 5

A method of subjecting the aluminum plate sequentially to:

(1) a chemical etching treatment;
(2) an electrochemical surface roughening treatment in an aqueous solution containing hydrochloric acid as the main ingredient;
(3) another chemical etching treatment;
(4) another electrochemical surface roughening treatment in an aqueous solution containing hydrochloric acid as the main ingredient;
(5) another chemical etching treatment; and
(6) an anodic oxidation treatment.

It is more preferable to perform the hydrophilic treatment, the sealing treatment, or a combination of the hydrophilic treatment and the sealing treatment after the anodic oxidation treatment. Among them, it is particularly preferable to perform the sealing treatment or the combination of the sealing treatment and the hydrophilic treatment.

It is preferable to perform the desmutting treatment in an acidic aqueous solution after each of the chemical etching treatments.

(Mechanical Surface Roughening Treatment)

In the manufacturing method of the present invention, the foregoing aluminum plate having the uneven pattern on the surface may be or may not be subjected to a mechanical surface roughening treatment using a rolling brush and an abrasive to be described later.

By performing the mechanical surface roughening treatment using the brush and the abrasive, it is possible to secure a large surface area by means of a subsequent brush graining treatment even if the aluminum plate has a small surface area after transfer of the uneven pattern. In this way, it is possible to achieve appropriate water retentivity. In the meantime, the mechanical surface roughening treatment can also solve the problems of the conventional surface roughening using only the brush and abrasive that sharp irregularities are formed on the surface to catch waste films, and that stains tend to remain in edge portions. In addition, the mechanical surface roughening treatment is able to reduce the amounts of alkaline etching to be performed later, and is therefore advantageous in light of manufacturing costs.

Now, a brush graining method advantageously used as the mechanical surface roughening treatment will be described.

Generally, the brush graining method uses a roller brush implanted with numerous bristles such as synthetic resin bristles made of nylon (trademark), propylene or polyvinyl chloride resin onto a surface of a cylindrical drum, and the method is performed by scrubbing one or both surfaces of the aluminum plate while spraying a slurry solution containing an abrasive onto the rotating roller brush. Instead of the roller brush and the slurry solution, it is also possible to use an abrasive roller which is a roller provided with an abrasive layer on a surface thereof.

When using the roller brush, a bend elastic constant of bristles for use is preferably in a range of 10,000 to 40,000 kg/cm$^2$, or more preferably in a range of 15,000 to 35,000 kg/cm$^2$. In addition, elastic strength of the bristles is preferably equal to or below 500 g, or more preferably equal to or below 400 g. The diameter of each bristle is generally in a range of 0.2 to 0.9 mm. The length of each bristle can be appropriately determined in accordance with the outside diameter of the roller brush and the diameter of the drum. However, the length of each bristle is generally in a range of 10 to 100 mm.

In the present invention, it is preferable to use a plurality of nylon brushes. To be more precise, it is preferable to use three or more brushes, and is more preferable to use four or more brushes. By adjusting the number of brushes, it is possible to adjust wavelength components of dents which are formed on the surface of the aluminum plate.

Meanwhile, the load of a drive motor for rotating the brush is preferably greater by at least 1 kW as compared to the load before pushing the brush roller against the aluminum plate. The difference in load is more preferably equal to or above 2 kW, and is even more preferably equal to or above 8 kW. By adjusting the load, it is possible to adjust depths of the dents formed on the surface of the aluminum plate. The number of revolution per minute of the brush is preferably not less than 100 or more preferably not less than 200.

Publicly known abrasives can be used herein. For example, it is possible to use abrasives such as pumice stone, silica sand, aluminum hydroxide, alumina powder, silicon carbide, silicon nitride, volcanic ash, carborundum, or emery; and a combination thereof. Among these abrasives, pumice stone and silica sand are preferable. Silica sand is excellent in surface roughening efficiency because silica sand is harder and more durable than pumice stone. On the other hand, aluminum hydroxide grains crack upon application of an excessive load. Accordingly, aluminum hydroxide is suitable for preventing generation of locally deep dents.

The median diameter of the abrasive is preferably in a range of 2 to 100 μm, or more preferably in a range of 20 to 60 μm, in terms of excellent surface roughening efficiency and a narrow graining pitch capability. By adjusting the median diameter of the abrasive, it is possible to adjust the depths of the dents formed on the surface of the aluminum plate.

The abrasive is suspended in water, for example, and is used as the slurry solution. In addition to the abrasive, the slurry solution may contain a thickener, a dispersing agent (such as a surfactant), an antiseptic, and the like. The specific gravity of the slurry solution is preferably in a range of 0.5 to 2.

As an apparatus suitable for the mechanical surface roughening treatment, it is possible to cite an apparatus as disclosed in JP 50-40047 B, for example.

Concerning details of the apparatus for performing the mechanical surface roughening treatment with the brushes and the abrasive, it is possible to use a technique disclosed by the applicant of the present invention in JP 2002-211159 A.

In the present invention, when an aluminum plate having a surface with uneven patterns formed by transfer is further subjected to the mechanical surface roughening treatment using the brushes and the abrasive, the Ra is preferably increased by an amount equal to or below 0.3 μm, more preferably equal to or below 0.2 μm, or most preferably equal to or below 0.1 μm.

<Surface Treatment>

In the method of manufacturing a support for a lithographic printing plate of the present invention, the support for a lithographic printing plate is obtained by subjecting the aluminum plate, which is provided with uneven patterns formed on the surface as described above, to the surface roughening treatment and an anodic oxidation treatment (these two treatments will be collectively referred to as the surface treatment in this present invention) as appropriate.

In the surface roughening treatment, the processes of the aspects 1 to 5 are preferably performed. For example, it is preferable to perform a (first) etching treatment in an alkaline aqueous solution, a (first) desmutting treatment in an acidic aqueous solution, an electrochemical surface roughening treatment in an aqueous solution containing nitric acid or hydrochloric acid, a (second) etching treatment in an alkaline aqueous solution, a (second) desmutting treatment in an acidic aqueous solution, an electrochemical surface roughening treatment in an aqueous solution containing hydrochloric acid, a (third) etching treatment in an alkaline aqueous solution, a (third) desmutting treatment in an acidic aqueous solution, and an anodic oxidation treatment in this order.

The method of manufacturing a support for a lithographic printing plate of the present invention may include other various processes in addition to the above-described processes.

It is also preferable to further perform a hydrophilic treatment after the anodic oxidation treatment.

Now, the respective processes of the surface treatment will be described in detail.

<First Alkaline Etching Treatment>

The alkaline etching treatment is a treatment for dissolving a surface layer of the above-described aluminum plate by allowing the aluminum plate to contact an alkaline solution.

The first alkaline etching treatment, which is performed prior to the first electrolytic treatment, aims at forming uniform dents in the first electrolytic treatment, or aims at removing rolling oil, stains, a natural oxide film, and the like on the surface of the aluminum plate (flat-rolled aluminum).

In the first alkaline etching, the etching amount is preferably equal to or above 0.1 $g/m^2$, more preferably equal to or above 0.5 $g/m^2$, even more preferably equal to or above 1 $g/m^2$ and most preferably equal to or above 10 $g/m^2$. Meanwhile, the etching amount is preferably equal to or below 10 $g/m^2$, more preferably equal to or below 8 $g/m^2$, and even more preferably equal to or below 5 $g/m^2$. When the lower limit of the etching amount remains in the above-described ranges, it is possible to form uniform pits in the first electrolytic treatment and further to prevent occurrence of unevenness in the treatment. When the upper limit of the etching amount remains in the above-described range, the amount of the alkaline aqueous solution used therein is reduced, and it is therefore economically advantageous.

The alkali to be used in the alkaline solution may be caustic alkali and alkali metal salt. To be more precise, the caustic alkali includes caustic soda and caustic potash, for example. Meanwhile, the alkali metal salt includes, for example: alkali metal silicate such as sodium metasilicate, sodium silicate, potassium metasilicate, or a potassium silicate; alkali metal carbonate such as sodium carbonate or potassium carbonate; alkali metal aluminate such as sodium aluminate or potassium aluminate; alkali metal aldonate such as sodium gluconate or potassium gluconate; alkali metal hydrogenphosphate such as sodium secondary phosphate, potassium secondary phosphate, sodium primary phosphate, or potassium primary phosphate. Among these compounds, a caustic alkali solution and a solution containing both of caustic alkali and alkali metal aluminate are preferred in terms of a high etching rate and a low price. A caustic soda aqueous solution is preferred in particular.

In the first alkaline etching treatment, the concentration of the alkaline solution is preferably equal to or above 30 g/L or more preferably equal to or above 300 g/L. Meanwhile, the concentration of the alkaline solution is preferably equal to or below 500 g/L or more preferably equal to or below 450 g/L.

Moreover, it is preferable that the alkaline solution contain aluminum ions. The aluminum ion concentration is preferably equal to or above 1 g/L or more preferably equal to or above 50 g/L. Meanwhile, the aluminum ion concentration is preferably equal to or below 200 g/L or more preferably equal to or below 150 g/L. Such an alkaline solution can be prepared by use of water, a 48-wt % caustic soda aqueous solution, and sodium aluminate, for example.

In the first alkaline etching treatment, the temperature of the alkaline solution is preferably equal to or above 30° C. or more preferably equal to or above 50° C. Meanwhile, the temperature is preferably equal to or below 80° C. or more preferably equal to or below 75° C.

In the first alkaline etching treatment, the treating time is preferably equal to or above 1 second or more preferably equal to or above 2 seconds. Meanwhile, the treating time is preferably equal to or below 30 seconds or more preferably equal to or below 15 seconds.

When the aluminum plates are continuously subjected to the etching treatment, the aluminum ion concentration in the alkaline solution is increased and the etching amounts of the aluminum plates thereby vary. Accordingly, it is preferable to manage compositions of the etching solution as described below.

Specifically, either a matrix of conductivity, specific gravity and temperature, or a matrix of conductivity, propagation velocity of ultrasonic waves and temperature is formed in advance, each of the matrices corresponding to a matrix of caustic soda concentration and the aluminum ion concentration. Then, the compositions of the solution are measured in terms of the conductivity, the specific gravity and the temperature or in terms of the conductivity, the propagation velocity of ultrasonic waves and the temperature, and caustic soda and water are added thereto so as to achieve target control values for the compositions of the solution. Thereafter, the etching solution, which is increased in volume by adding caustic soda and water, is allowed to overflow from a circulation tank so as to maintain the constant volume. As for caustic soda for such addition, it is possible to use one for industrial use which contains 40 to 60 wt % therein.

A conductivity detector and a gravimeter used therein are preferably temperature compensated, respectively. Here, it is preferable to use a gravimeter of a differential pressure type.

The method of allowing the aluminum plate to contact the alkaline solution includes a method of allowing the aluminum plate to pass through a tank filled with the alkaline solution, a method of dipping the aluminum plate in a tank filled with the alkaline solution, and a method of spraying the alkaline solution on the surface of the aluminum plate.

Among these methods, the method of spraying the alkaline solution on the surface of the aluminum plate is preferred. To be more precise, it is preferable to apply the method of spraying the etching solution by using a spray tube provided with pores which have diameters in a range of 2 to 5 mm and are arranged with spaces in a range of 10 to 50 mm. Here, it is preferable to spray the etching solution in an amount of 10 to 100 L/min for each spray tube. A plurality of spray tubes are preferably provided therein.

After completing the alkaline etching treatment, it is preferable to drain the solution off with a nip roller, then to perform a water washing treatment for 1 to 10 seconds, and then to drain the water off with the nip roller.

The water washing treatment is preferably carried out by using an apparatus configured to perform a water washing treatment with a liquid film of a free-fall curtain shape, and then using the spray tubes.

FIG. 1 is a schematic cross-sectional view of an apparatus for performing a water washing treatment with a liquid film of a free-fall curtain shape. As shown in FIG. 1, an apparatus 100 configured to perform a water washing treatment with a liquid film of a free-fall curtain shape includes a water storage tank 104 for storing water 102, a water supply tube 106 for supplying the water storage tank 104 with water, and a flow controller unit 108 for supplying a liquid film of a free-fall curtain shape from the water storage tank 104 to the aluminum plate 1.

In this apparatus 100, water 102 is supplied from the water supply tube 106 to the water storage tank 104 and the water flow is controlled by the flow controller unit 108 when the water 102 overflows from the water storage tank 104, whereby the liquid film of the free-fall curtain shape is supplied to the aluminum plate 1. When using this apparatus 100, the fluid volume is preferably in a range of 10 to 100 L/min. Meanwhile, the distance L in which water 102 exists as the liquid film of the free-fall curtain shape between the apparatus 100 and the aluminum 1 is preferably in a range of 20 to 50 mm. Furthermore, the angle $\alpha$ of the aluminum plate is preferably in a range of 30° to 80° relative to the horizontal direction.

By using the apparatus configured to perform a water washing treatment with a liquid film of a free-fall curtain shape as shown in FIG. 1, it is possible to perform the water washing treatment uniformly on the aluminum plate. Accordingly, it is possible to enhance uniformity of the treatments which are carried out prior to the water washing treatments.

The apparatus configured to perform a water washing treatment with a liquid film of a free-fall curtain shape may be preferably an apparatus disclosed in JP 2003-96584 A, for example.

Meanwhile, as the spray tube for use in the water washing treatment, it is possible to use a spray tube provided with a plurality of spray tips arranged along the width direction of the aluminum plate, which are configured to fan out injection water. The distance between the adjacent spray tips is preferably in a range of 20 to 100 mm, and the fluid volume for each spray tip is preferably in a range of 0.5 to 20 L/min. It is preferable to use a plurality of such spray tubes.

<First Desmutting Treatment>

After performing the first alkaline etching treatment, it is preferable to perform acid washing (a first desmutting treatment) in order to remove stains (smuts) remaining on the surface. The desmutting treatment is carried out by allowing the aluminum plate to contact an acidic solution.

Acids used herein include nitric acid, sulfuric acid, phosphoric acid, chromic acid, hydrofluoric acid, and fluoroboric acid, for example.

Here, in the first desmutting treatment to be carried out after the first alkaline etching treatment, if electrolysis in nitric acid is subsequently carried out as the first electrolytic treatment, then it is preferable to use overflow waste of an electrolytic solution used in the electrolysis in nitric acid.

Upon management of compositions of a desmutting solution, it is possible to select and use any of a method of management by conductivity and temperature corresponding to a matrix of concentration of the acidic solution and the aluminum ion concentration, a method of management by conductivity, specific gravity and temperature corresponding to the same, and a method of management by conductivity, propagation velocity of ultrasonic waves and temperature corresponding to the same.

In the first desmutting treatment, it is preferable to use the acidic solution containing an acid in a range of 1 to 400 g/L and aluminum ions in a range of 0.1 to 5 g/L.

Temperature of the acidic solution is preferably equal to or above 20° C., or more preferably equal to or above 30° C. Meanwhile, the temperature is preferably equal to or below 70° C., or more preferably equal to or below 60° C.

In the first desmutting treatment, the treating time is preferably equal to or above 1 second, or more preferably equal to or above 4 seconds. Meanwhile, the treating time is preferably equal to or below 60 seconds, or more preferably equal to or below 40 seconds.

The method of allowing the aluminum plate to contact the acidic solution includes a method of allowing the aluminum plate to pass through a tank filled with the acidic solution, a method of dipping the aluminum plate in a tank filled with the acidic solution, and a method of spraying the acidic solution on the surface of the aluminum plate.

Among these methods, the method of spraying the acidic solution on the surface of the aluminum plate is preferred. To be more precise, it is preferable to apply the method of spraying the desmutting solution by using a spray tube provided with pores which have diameters in a range of 2 to 5 mm and are arranged with spaces in a range of 10 to 50 mm. Here, it is preferable to spray the desmutting solution in an amount of 10 to 100 L/min for each spray tube. A plurality of spray tubes are preferably provided therein.

After completing the desmutting treatment, it is preferable to drain the solution off with a nip roller, then to perform a water washing treatment for 1 to 10 seconds, and then to drain the water off with the nip roller.

The water washing treatment is similar to the water washing treatment which is carried out after the alkaline etching treatment. However, the fluid volume for each spray tip is preferably in a range of 1 to 20 L/min.

Here, in the first desmutting treatment, if the overflow waste of the electrolytic solution to be used in the subsequent electrolysis in nitric acid is used as the desmutting solution, then it is preferable to cancel draining with the nip roller and the water washing treatment after the desmutting treatment. Instead, it is preferable to handle the aluminum plate until the process of electrolysis in nitric acid while spraying the desmutting solution as appropriate to prevent the surface of the aluminum plate from drying.

<First Electrolytic Treatment>

The first electrolytic treatment is an electrochemical surface roughening treatment to be performed in an aqueous solution containing nitric acid or hydrochloric acid.

It is possible to form grain shapes of superposition of highly uniform uneven structures on the surface of the aluminum plate by carrying out the first electrolytic treatment and the second electrolytic treatment as shown in the surface treatment aspects 1, 4 and 5. In this way, it is possible to achieve excellent stain resistance and press life.

Here, average roughness Ra of the surface of the aluminum plate after the first electrolytic treatment is preferably in a range of 0.45 to 0.85 μm.

In the surface treatment aspects 2 and 3, electrochemical surface roughening treatment using nitric acid and that using hydrochloric acid are performed, respectively. In the surface treatment aspect 4, electrolysis in nitric acid is performed after electrolysis in hydrochloric acid. In the surface treatment aspect 5, electrolysis in hydrochloric acid is performed twice. The surface treatment aspect 1 will be mainly described below, but the respective conditions in the other aspects can be changed in accordance with their respective features.

(Electrochemical Surface Roughening Treatment in an Aqueous Solution Containing Nitric Acid)

By the electrochemical surface roughening treatment in the aqueous solution containing nitric acid (the electrolysis in nitric acid), it is possible to form favorable uneven structures on the surface of the aluminum plate. In the present invention, when the aluminum plate contains relatively a large amount of Cu, relatively large and uniform dents are formed by the electrolysis in nitric acid. As a result, a lithographic printing plate using the support for a lithographic printing plate obtained by the present invention will have excellent press life.

The aqueous solution containing nitric acid usable herein may be one applicable to an electrochemical surface roughening treatment using a normal direct current or a normal alternating current. Here, it is possible to add at least one of nitrate compounds having nitrate ions, such as aluminum nitrate, sodium nitrate or ammonium nitrate, in a range of 1 g/L to a saturation level, to the aqueous solution containing nitric acid in a concentration of 1 to 100 g/L upon use. Moreover, metal contained in the aluminum alloy such as iron, copper, manganese, nickel, titanium, magnesium or silica may be dissolved in the aqueous solution containing nitric acid. It is also possible to add hypochlorous acid or hydrogen peroxide in an amount of 1 to 100 g/L.

To be more precise, it is preferable to use the solution prepared by dissolving aluminum nitrate in the nitric acid aqueous solution having the nitric acid concentration in a range of 5 to 15 g/L, so as to adjust the aluminum ion concentration to 3 to 7 g/L.

Further, uniform graining of an aluminum plate containing a large amount of Cu is made possible by adding and using a compound which may form a complex with Cu. Examples of the compound which may form a complex with Cu include ammonia; amines obtained by substituting a hydrogen atom of the ammonia with an (aliphatic or aromatic) hydrocarbon group or the like as exemplified by methylamine, ethylamine, dimethylamine, diethylamine, trimethylamine, cyclohexylamine, triethanolamine, triisopropanolamine and EDTA (ethylenediaminetetraacetic acid); and metal carbonates such as sodium carbonate, potassium carbonate and potassium hydrogencarbonate. Ammonium salts such as ammonium nitrate, ammonium chloride, ammonium sulfate, ammonium phosphate and ammonium carbonate are also included.

Temperature of the aqueous solution containing nitric acid is preferably in a range of 30° C. to 55° C. inclusive.

It is possible to form the pits having an average pore size in a range of 1 to 10 μm by means of the electrolysis in nitric acid. Note that an electrolytic reaction is condensed when a quantity of electricity is relatively higher, and honeycomb pits exceeding 10 μm are also generated.

To obtain such grains, a total quantity of electricity contributing to an anodic reaction of the aluminum plate at the point of termination of the electrolytic reaction is preferably equal to or above 150 $C/dm^2$, or more preferably equal to or above 170 $C/dm^2$. Meanwhile, the total quantity of electricity is preferably equal to or below 600 $C/dm^2$, or more preferably equal to or below 500 $C/dm^2$. Current density in this case is preferably in a range of 20 to 100 $A/dm^2$ in terms of a peak current value when using an alternating current, or in a range of 20 to 100 $A/dm^2$ when using a direct current.

When a pre-electrolysis is performed before the electrolysis in nitric acid, more uniform dents are formed in the electrolysis in nitric acid.

The pre-electrolysis is a process in which the starting points in the pit formation during the electrolysis in nitric acid are formed. The pre-electrolysis is not susceptible to the material of the aluminum plate and pits as the starting points can be uniformly formed on the surface of the aluminum plate by slightly performing the electrolysis using highly corrosive hydrochloric acid.

In the pre-electrolysis, the hydrochloric acid concentration is preferably in a range of 1 to 15 g/L. The quantity of electricity in the anodic reaction is preferably in a range of 30 to 70 $C/m^2$.

An alkali etching treatment is preferably performed for desmutting after the pre-electrolysis. The amount of aluminum dissolved during the alkali etching is preferably in a range of 0.2 to 0.6 $g/m^2$.

(Electrochemical Surface Roughening Treatment in Aqueous Solution Containing Hydrochloric Acid)

The aqueous solution containing hydrochloric acid usable herein may be one applicable to an electrochemical surface roughening treatment using a normal direct current or a normal alternating current. Here, it is possible to add at least one of chloride or nitrate compounds including ones having nitrate ions such as aluminum nitrate, sodium nitrate or ammonium nitrate, and ones having chlorine ions such as aluminum chloride, sodium chloride or ammonium chloride in a range of 1 g/L to a saturation level to the aqueous solution containing hydrochloric acid in a concentration of 1 to 30 g/L or more preferably 2 to 10 g/L upon use. Moreover, it is possible to add a compound, which forms a complex with copper, in a proportion of 1 to 200 g/L. Metal contained in the aluminum alloy such as iron, copper, manganese, nickel, titanium, magnesium or silica may be dissolved in the aqueous solution containing hydrochloric acid. It is also possible to add hypochlorous acid or hydrogen peroxide in an amount of 1 to 100 g/L.

As for the aqueous hydrochloric acid solution, it is particularly preferable to prepare the aqueous solution by adding 27 to 63 g/L of aluminum salt (aluminum chloride: $AlCl_3.6H_2O$) to an aqueous solution containing hydrochloric acid in a concentration of 2 to 10 g/L so as to adjust the aluminum ion concentration preferably in a range of 3 to 7 g/L or more preferably in a range of 4 to 6 g/L. When the electrochemical surface roughening treatment is carried out by use of the above-described aqueous hydrochloric acid solution, uniform surface shapes are obtained by the surface roughening treatment. Accordingly, unevenness does not occur in the surface roughening treatment regardless of whether a low-purity aluminum flat-rolled plate or a high-purity aluminum flat-rolled plate is used. As a result, it is possible to satisfy excellent press life and stain resistance when such an aluminum flat-rolled plate is formed into a lithographic printing plate.

Temperature of the aqueous solution containing hydrochloric acid is preferably equal to or above 25° C. or more preferably equal to or above 30° C. Meanwhile, the temperature is preferably equal to or below 55° C. or more preferably equal to or below 40° C.

Concerning additives for the aqueous solution containing hydrochloric acid, apparatuses, power sources, current density, flow rates, and temperature, it is possible to apply publicly known techniques for use in electrochemical surface roughening. Although both of an alternating current and a direct current are applicable to the power source used in electrochemical surface roughening, an alternating current is particularly preferred.

Hydrochloric acid itself possesses high aluminum dissolving power. Accordingly, it is possible to form fine irregularities on the surface only by applying a small current. Such fine irregularities have an average pore size in a range of 0.01 to 0.4 μm and are generated uniformly on the entire surface of the aluminum plate.

When the quantity of electricity is raised further, larger pits having an average pore size in a range of 1 to 15 μm provided with smaller pits having an average pore size in a range of 0.01 to 0.4 μm on the surfaces of the larger pits are formed. To obtain such grains, the total quantity of electricity contributing to the anodic reaction of the aluminum plate at the point of termination of the electrolytic reaction is preferably equal to or above 10 $C/dm^2$, more preferably equal to or above 50 $C/dm^2$, or even more preferably equal to or above 100 $C/dm^2$. Meanwhile, the total quantity of electricity is preferably equal to or below 2000 $C/dm^2$, or more preferably equal to or below 600 $C/dm^2$.

It is also possible to simultaneously form a crater-like large undulation by increasing the total quantity of electricity used for an anodic reaction to 150 to 2,000 $C/dm^2$ in the first electrolysis in hydrochloric acid. Also in this case, pits having an average pore size in a range of 1 to 15 μm are formed, with fine irregularities having an average pore size in a range of 0.01 to 0.4 μm being formed on the surfaces thereof. Current density in this case is preferably in a range of 20 to 100 $A/dm^2$ in terms of a peak current value.

When the aluminum plate is subjected to the electrolysis in hydrochloric acid while applying such a large quantity of electricity, it is possible to form large undulation and fine irregularities at the same time. It is possible to improve stain resistance by homogenizing the large undulation by the second alkaline etching to be described later.

The first electrolytic treatment using the aqueous solution containing nitric acid or hydrochloric acid can be performed in accordance with electrochemical graining methods (electrolytic graining methods) as disclosed in JP 48-28123 B and GB 896563 B, for example. Although these electrolytic graining methods use an alternating current having a sinusoidal waveform, it is also possible to use a special waveform as disclosed in JP 52-58602 A. It is also possible to use a waveform as disclosed in JP 3-79799 A. Meanwhile, it is also possible to apply methods disclosed in JP 55-158298 A, JP 56-28898 A, JP 52-58602 A, JP 52-152302 A, JP 54-85802 A, JP 60-190392 A, JP 58-120531 A, JP 63-176187 A, JP 1-5889 A, JP 1-280590 A, JP 1-118489 A, JP 1-148592 A, JP 1-178496 A, JP 1-188315 A, JP 1-154797 A, JP 2-235794 A, JP 3-260100 A, JP 3-253600 A, JP 4-72079 A, JP 4-72098 A, JP 3-267400 A, and JP 1-141094 A. In addition to the above, it is also possible to perform electrolysis by use of an alternating current having a special frequency which is disclosed as a method of manufacturing an electrolytic capacitor. Such a manufacturing method is disclosed in U.S. Pat. Nos. 4,276,129 and 4,676,879.

Although various techniques have been disclosed concerning electrolytic tanks and power sources, it is possible to apply methods disclosed in U.S. Pat. No. 4,203,637, JP 56-123400 A, JP 57-59770 A, JP 53-12738 A, JP 53-32821 A, JP 53-32822 A, JP 53-32823 A, JP 55-122896 A, JP 55-132884 A, JP 62-127500 A, JP 1-52100 A, JP 1-52098 A, JP 60-67700 A, JP 1-230800 A, and JP 3-257199 A.

In addition, it is also possible to apply methods disclosed in JP 52-58602 A, JP 52-152302 A, JP 53-12738 A, JP 53-12739 A, JP 53-32821 A, JP 53-32822 A, JP 53-32833 A, JP 53-32824 A, JP 53-32825 A, JP 54-85802 A, JP 55-122896 A, JP 55-132884 A, JP 48-28123 B, JP 51-7081 B, JP 52-133838 A, JP 52-133840 A, JP 52-133844 A, JP 52-133845 A, JP 53-149135 A, and JP 54-146234 A.

When the aluminum plates are continuously subjected to the electrolytic surface roughening treatment, the aluminum ion concentration in the solution is increased and the shapes of irregularities on the aluminum plate formed by the first electrolytic treatment thereby vary. Accordingly, it is preferable to manage compositions of a nitric acid electrolytic solution or a hydrochloric acid electrolytic solution as described below.

Specifically, either a matrix of conductivity, specific gravity and temperature, or a matrix of conductivity, propagation velocity of ultrasonic waves and temperature is formed in advance, each of the matrices corresponding to a matrix of a nitric or hydrochloric acid concentration and the aluminum ion concentration. Then, the compositions of the solution are measured in terms of the conductivity, the specific gravity and the temperature or in terms of the conductivity, the propagation velocity of ultrasonic waves and the temperature, and nitric or hydrochloric acid and water are added thereto so as to achieve target control values for the compositions of the solution. Thereafter, the electrolytic solution, which is increased in volume by adding nitric or hydrochloric acid and water, is allowed to overflow from a circulation tank so as to maintain the constant volume. As for nitric acid for such addition, it is possible to use one for industrial use which contains 30 to 70 wt % therein. As for hydrochloric acid for such addition, it is possible to use one for industrial purposes which contains 30 to 40 wt % therein.

A conductivity detector and a gravimeter used therein are preferably temperature compensated, respectively. Here, it is preferable to use a gravimeter of a differential pressure type.

In order to achieve higher accuracy, it is preferable that a sample collected from the electrolytic solution for measurement of the compositions of the solution be used for such measurement after controlling the solution to certain temperature (such as 40±0.5° C.) with a heat exchanger apart from one for the electrolytic solution.

Figure 5:
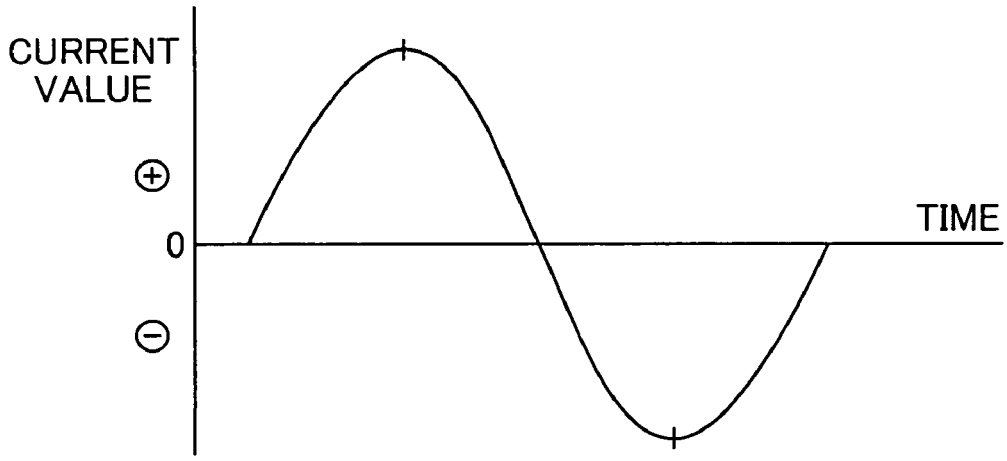
FIG. 5 is a graph showing an example of a sinusoidal waveform chart used in the electrochemical surface roughening treatment in the method of manufacturing a support for a lithographic printing plate of the present invention.

The electrolytic current waveform used in the electrochemical surface roughening treatment is not particularly limited, and a sinusoidal wave, a rectangular wave, a trapezoidal wave, a triangular wave, and the like are applicable. However, it is preferable to use any of the sinusoidal wave, the rectangular wave, and the trapezoidal wave. Among those waves, the trapezoidal wave is particularly preferred. In the case of the first electrolysis in hydrochloric acid, the sinusoidal wave is particularly preferred because it is easier to generate uniform pits having an average diameter equal to or above 1 μm. The sinusoidal wave is the one shown in FIG. 5.

Figure 2:
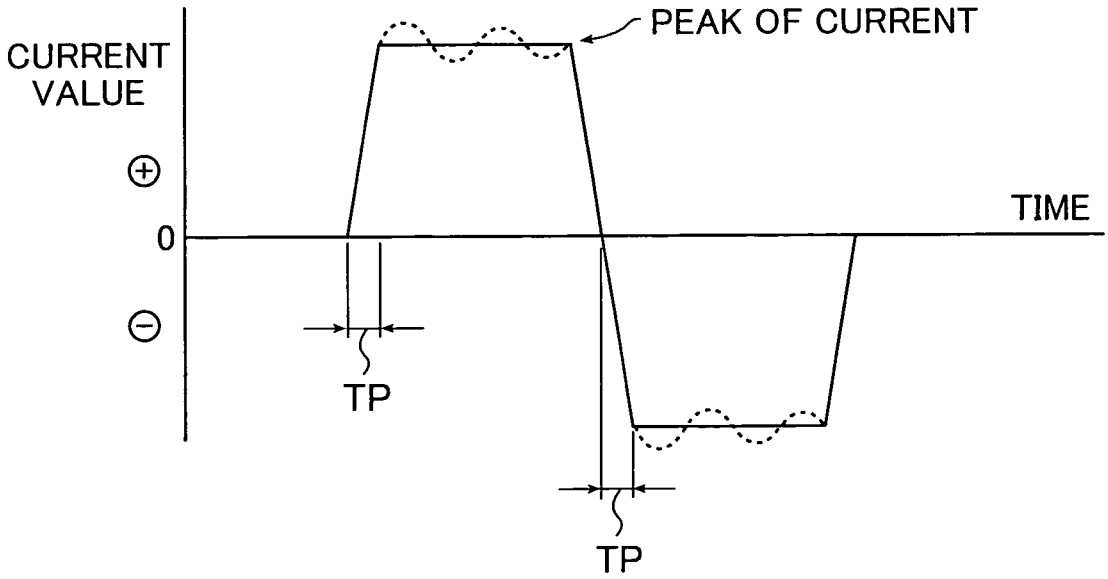
FIG. 2 is a graph showing an example of an alternating current waveform chart used for an electrochemical surface roughening treatment in a method of manufacturing a support for a lithographic printing plate of the present invention.

The trapezoidal wave is the one shown in FIG. 2. In terms of this trapezoidal wave, time (TP) consumed by a current to reach from zero to a peak is preferably in a range of 0.5 to 3 msec. If the time TP exceeds 3 msec, an aluminum plate becomes susceptible to minor components in the electrolytic solution typified by ammonium ions which are spontaneously increased by the electrolytic treatment particularly when using the aqueous solution containing nitric acid. Accordingly, it is difficult to achieve uniform graining. As a result, stain resistance tends to be reduced when the aluminum plate is formed into a lithographic printing plate.

It is possible to use an alternating current having a duty ratio (ta/T; ratio of the anodic reaction time in one cycle) in a range of 1:2 to 2:1. However, as disclosed in JP 5-195300 A, it is preferable to apply an alternating current having a duty ratio of 1:1 in an indirect feeding mode where a conductor roll is not used for aluminum.

It is possible to use an alternating current having a frequency in a range of 0.1 to 120 Hz. However, in light of facilities, it is preferable to use an alternating current having a frequency in a range of 50 to 70 Hz. When the frequency is below 50 Hz, a carbon electrode which is a main electrode tends to be dissolved easily. On the contrary, when the frequency is above 70 Hz, the current condition is susceptible to inductance components on a power circuit and power costs are thereby increased.

Figure 3:
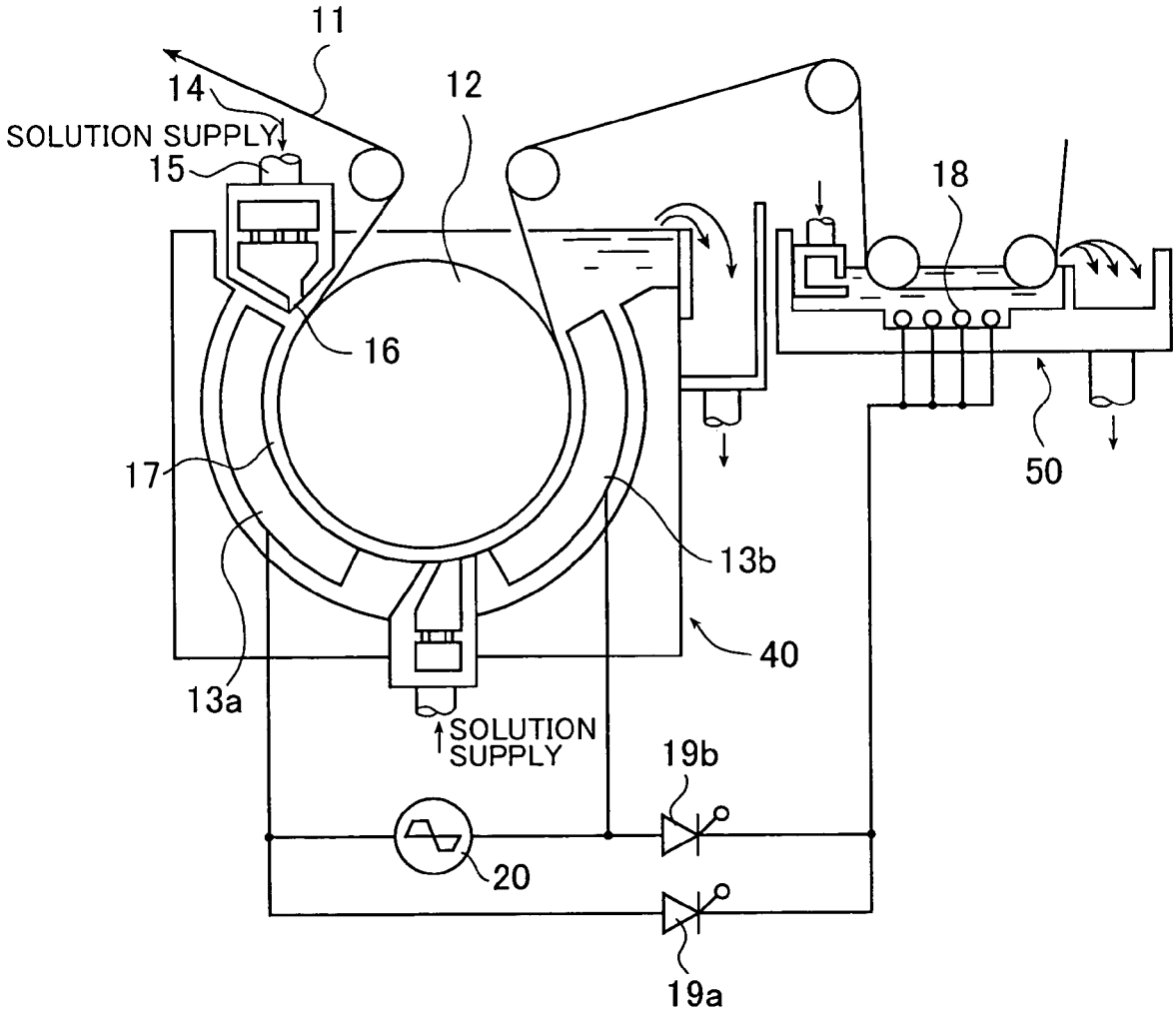
FIG. 3 is a side view showing an example of a radial type cell for the electrochemical surface roughening treatment using an alternating current in the method of manufacturing a support for a lithographic printing plate of the present invention.

FIG. 3 is a side view showing an example of radial type cell for the electrochemical surface roughening treatment using the alternating current in the method of manufacturing a support for a lithographic printing plate of the present invention.

One or more alternating current power sources can be connected to an electrolytic tank. In order to perform uniform graining by controlling the current ratio between an anode and a cathode of an alternating current applied to an aluminum plate opposed to main electrodes and in order to dissolve carbon in the main electrodes, it is preferable to dispose auxiliary anodes as shown in FIG. 3 and to shunt a part of the alternating current. In FIG. 3, reference numeral 11 denotes an aluminum plate, reference numeral 12 denotes a radial drum roller, reference numerals 13*a* and 13*b* denote main electrodes, reference numeral 14 denotes an electrolytic solution, reference numeral 15 denotes an electrolytic solution inlet, reference numeral 16 denotes a slit, reference numeral 17 denotes an electrolytic solution passage, reference numeral 18 denotes auxiliary anodes, reference numerals 19*a* and 19*b* denote thyristors, reference numeral 20 denotes an alternating power source, reference numeral 40 denotes a main electrolytic tank, and reference numeral 50 denotes an auxiliary anode tank. By shunting a part of a current as a direct current into the auxiliary anodes provided apart from the two main electrodes in a different tank through a rectifier or a switching element, it is possible to control the ratio between a current value contributing to an anodic reaction acting on the aluminum plate opposed to the main electrodes and a current value contributing to a cathodic reaction. The ratio of the quantity of electricity contributing to the anodic reaction and the cathodic reaction (the quantity of electricity at the cathodic reaction/the quantity of electricity at the anodic reaction) on the aluminum plate opposed to the main electrodes is preferably in a range of 0.3 to 0.95.

Any types of publicly known electrolytic tanks applied to surface treatments, such as a vertical type, a flat type, or a radial type, can be used as the electrolytic tank. However, a radial type electrolytic tank as disclosed in JP 5-195300 A is particularly preferred. The electrolytic solution passing through the electrolytic tank may flow in a parallel direction or in a counter direction relative to a traveling direction of an aluminum web.

Meanwhile, in an electrochemical surface roughening treatment applying a direct current, it is possible to use an electrolytic solution which is used in an electrochemical surface roughening treatment applying a normal direct current. To be more precise, it is possible to use an electrolytic solution which is similar to the electrolytic solution used in the above-described electrochemical surface roughening treatment applying the alternating current.

The direct current power source waveform used in the electrochemical surface roughening treatment is not particularly limited as long as the current does not change polarity, and a comb-shaped wave, a continuous direct current, a wave obtained by subjecting a commercial alternating current to full-wave rectification with a thyristor, and the like are applicable. However, it is preferable to use a smoothed continuous direct current.

Although it is possible to perform the electrochemical surface roughening treatment applying the direct current in accordance with any of the batch method, the semicontinuous method, and the continuous method. However, it is preferable to adopt the continuous method.

An apparatus to be used in the electrochemical surface roughening treatment applying the direct current is not particularly limited as long as the apparatus is configured to apply a direct current voltage between anodes and cathodes which are arranged alternately and to allow an aluminum plate to pass through the anodes and the cathodes while maintaining the clearance.

Figure 6:
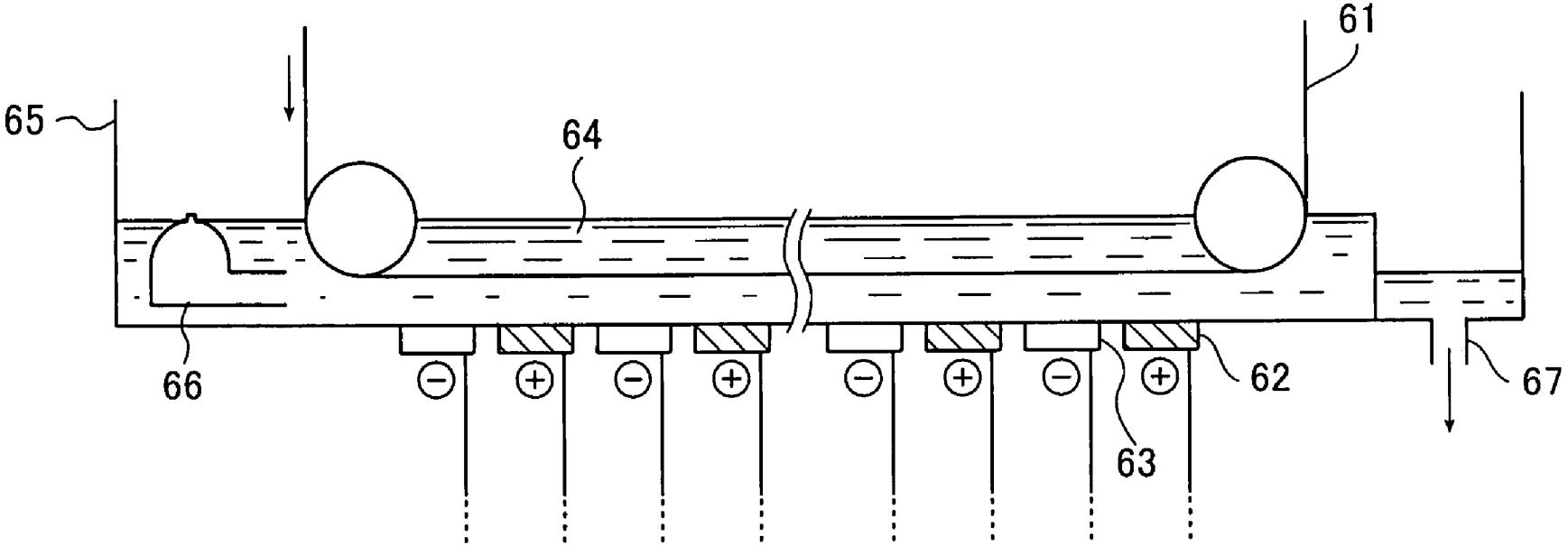
FIG. 6 is a side view showing an example of an apparatus used in an electrochemical surface roughening treatment using a direct current in the method of manufacturing a support for a lithographic printing plate of the present invention.

For example, an apparatus having one electrolytic tank as shown in FIG. 6 is illustrated. In FIG. 6, an aluminum plate 61 passes through the electrolytic tank 65 filled with an electrolytic solution 64. An direct voltage is applied between anodes 62 and cathodes 63 alternately disposed in the electrolytic tank 65. The electrolytic solution 64 is supplied from a supply nozzle 66 to the electrolytic tank 65 and is discharged through a discharge tube 67.

Figure 7:
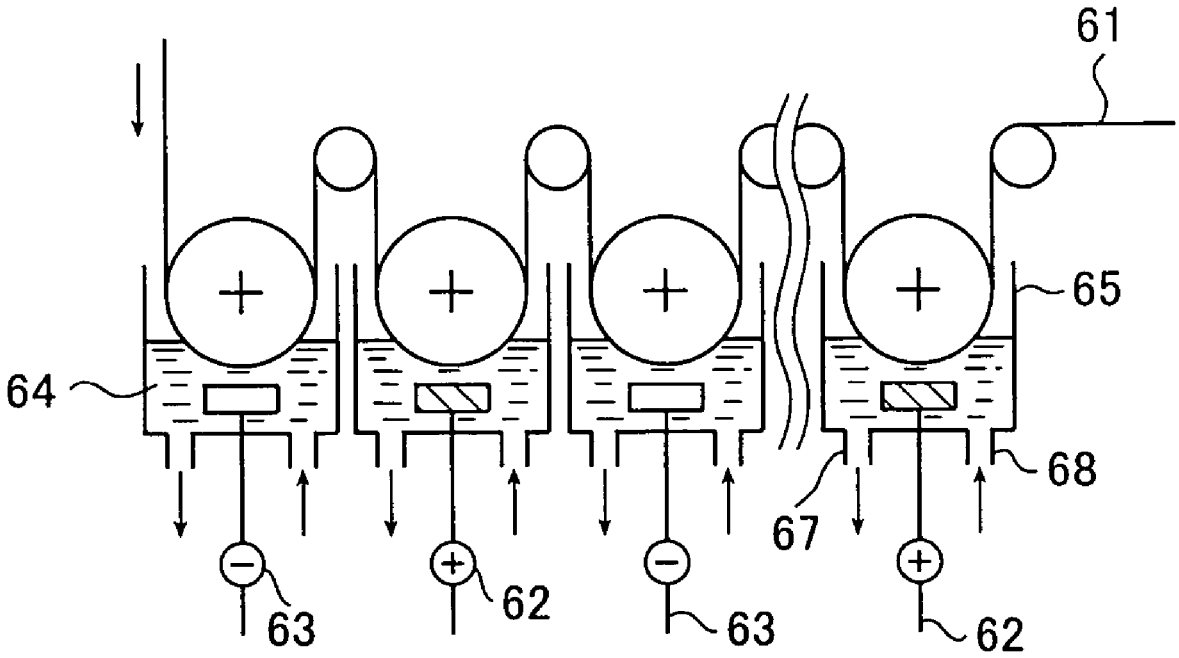
FIG. 7 is a side view showing another example of the apparatus used in the electrochemical surface roughening treatment using a direct current in the method of manufacturing a support for a lithographic printing plate of the present invention.

Another apparatus shown in FIG. 7 which includes separate electrolytic tanks for anodes 62 and cathodes 63 is also illustrated. In FIG. 7, an aluminum plate 61 passes through electrolytic tanks 65 filled with an electrolytic solution 64. The anodes 62 and the cathodes 63 are alternately disposed in the respective electrolytic tanks 65. A direct voltage is applied between the anodes 62 and the cathodes 63 disposed alternately. The electrolytic solution 64 is supplied from a supply tube 68 to each electrolytic tank 65 and is discharged through an discharge tube 67.

The electrodes are not particularly limited. It is possible to use publicly known electrodes which are conventionally used in electrochemical surface roughening treatments.

As for the anode, it is preferable to use: an anode formed by plating or cladding platinum-group metal on valve metal such as titanium, tantalum or niobium; an anode formed by coating or sintering a platinum-group metal oxide on the valve metal; aluminum; stainless steel, for example. Among these anodes, an anode formed by cladding platinum on the valve metal is preferred. A method such as water cooling by passing water inside the electrode can further extend the anode life.

As for the cathode, it is possible to select metal or the like from the Pourbaix diagram, which is not dissolved when electrode potential is set negative. Among such substances, carbon is preferred.

Arrangement of the electrodes can be selected appropriately. Moreover, it is possible to adjust the wave structure by changing lengths of the anode and cathode in the traveling direction of the aluminum plate, changing passage time of the aluminum plate, or by changing a flow rate, temperature, compositions or current density of the electrolytic solution. Meanwhile, when using an apparatus provided with a tank for the anode and a tank for a cathode separately as shown in FIG. 7, it is also possible to change electrolytic conditions of the respective treatment tanks.

The surface of a support is photographed at a magnification of 2,000× or 50,000× from right above with an electron microscope. Next, in an electron micrograph obtained, at least 50 pits whose circumferences are annularly connected are extracted, the pore sizes are determined by reading the diameters of the pits, and an average pore size is calculated. The average pore size of the dents generated in the first electrolytic treatment was thus measured.

In addition, in order to suppress dispersion among measurements, an equivalent circle diameter may be measured with commercial image analysis software. In this case, the aforementioned electron micrograph is captured with a scanner to be digitized, and the digital data is converted into binary data using the software, after which an equivalent circle diameter is determined.

The measurement results by the inventors showed that a visual measurement and the digital processing had almost the same values.

After completing the first electrolytic treatment, it is preferable to drain the solution off with a nip roller, then to perform a water washing treatment for 1 to 10 seconds, and then to drain the water off with the nip roller.

The water washing treatment is preferably carried out by use of spray tubes. As the spray tube for use in the water washing treatment, it is possible to use a spray tube provided with a plurality of spray tips arranged along the width direction of the aluminum plate, which are configured to fan out injection water. The distance between the adjacent spray tips is preferably in a range of 20 to 100 mm, and a fluid volume of each spray tip is preferably in a range of 1 to 20 L/min. It is preferable to use a plurality of such spray tubes.

<Second Alkaline Etching Treatment>

The second alkaline etching treatment, which is carried out between the first electrolytic treatment and the second electrolytic treatment, aims at dissolving smuts generated in the first electrolytic treatment and dissolving edge portions of the pits formed by the first electrolytic treatment. By applying the second alkaline etching treatment, the edge portions of the large pits formed by the first electrolytic treatment are dissolved and the surface is thereby smoothed. As a consequence, ink will not be easily caught by the edge portions. Accordingly, it is possible to obtain a presensitized plate having excellent stain resistance.

The second alkaline etching treatment is basically similar to the first alkaline etching treatment. Accordingly, only the difference will be described below.

In the second alkaline etching treatment, the etching amount is preferably equal to or above 0.05 g/m$^2$, or more preferably equal to or above 0.1 g/m$^2$. Meanwhile, the etching amount is preferably equal to or below 4 g/m$^2$, or more preferably equal to or below 3.5 g/m$^2$. When the etching amount is equal to or above 0.05 g/m$^2$, the edge portions of the pits generated in the first electrolytic treatment are smoothed in a non-image area of the lithographic printing plate and ink is hardly caught by the edge portions. Accordingly, it is possible to achieve excellent stain resistance. In the meantime, when the etching amount is equal to or below 4 g/m$^2$, the irregularities generated in the first electrolytic treatment are increased in size. Accordingly, it is possible to achieve excellent press life.

In the second alkaline etching treatment, the concentration of the alkaline solution is preferably equal to or above 30 g/L, or more preferably equal to or above 300 g/L. Meanwhile, the concentration of the alkaline solution is preferably equal to or below 500 g/L, or more preferably equal to or below 450 g/L.

Moreover, it is preferable that the alkaline solution contain aluminum ions. The aluminum ion concentration is preferably equal to or above 1 g/L, or more preferably equal to or above 50 g/L. Meanwhile, the aluminum ion concentration is preferably equal to or below 200 g/L, or more preferably equal to or below 150 g/L.

<Second Desmutting Treatment>

After performing the second alkaline etching treatment, it is preferable to perform acid washing (second desmutting treatment) in order to remove stains (smuts) remaining on the surface. The second desmutting treatment can be carried out in the same method as the first desmutting treatment.

It is preferable to use either nitric acid or sulfuric acid in the second desmutting treatment.

In the second desmutting treatment, it is preferable to use an acidic solution containing an acid in a range of 1 to 400 g/L and aluminum ions in a range of 0.1 to 8 g/L.

To be more precise, when using sulfuric acid, it is possible to use a solution prepared by dissolving aluminum sulfate in a sulfuric acid aqueous solution having a sulfuric acid concentration in a range of 100 to 350 g/L, so as to adjust the aluminum ion concentration to a range of 0.1 to 5 g/L. Alternatively, it is possible to use overflow waste of an electrolytic solution used in the anodic oxidation treatment to be described later.

In the second desmutting treatment, the treating time is preferably equal to or above 1 second, or more preferably equal to or above 4 seconds. Meanwhile, the treating time is preferably equal to or below 60 seconds, or more preferably equal to or below 20 seconds.

In the second desmutting treatment, temperature of the acidic aqueous solution is preferably equal to or above 20° C., or more preferably equal to or above 30° C. Meanwhile, the temperature is preferably equal to or below 70° C., or more preferably equal to or below 60° C.

<Second Electrolytic Treatment>

The second electrolytic treatment is an electrochemical surface roughening treatment to be performed in an aqueous solution containing hydrochloric acid by use of an alternating or direct current. By combining the above-mentioned first electrolytic treatment with the second electrolytic treatment, it is possible to form more complicated uneven structures on the surface of the aluminum plate and thereby to achieve excellent press life. The second electrolytic treatment is capable of generating dents having an average diameter of 0.01 to 0.4 μm on the surface of the aluminum plate smoothened by the second alkali etching treatment, thereby enhancing the press life.

The second electrolysis in hydrochloric acid to be performed after the first electrolytic treatment is basically similar to those described in terms of the first electrolysis in hydrochloric acid.

The total quantity of electricity received by the aluminum plate in the anodic reaction in the course of electrochemical surface roughening in the aqueous solution containing hydrochloric acid used in the second electrolysis in hydrochloric acid can be selected in a range of 10 to 200 C/dm$^2$ at a point of completion of the electrochemical surface roughening treatment. The total quantity of electricity is preferably in a range of 10 to 100 C/dm$^2$, or more preferably in a range of 50 to 80 C/dm$^2$.

When the first electrolysis in hydrochloric acid is performed as the first electrolytic treatment, it is preferable that the total quantity of electricity Q1 in the anodic reaction at a point of completion of the first electrolysis in hydrochloric acid be larger than the total quantity of electricity Q2 in the anodic reaction at a point of completion of the second electrolysis in hydrochloric acid (Q1>Q2). The pits having an average pore size in a range of 1 to 15 μm as generated by the first electrolysis in hydrochloric acid increases the surface area of the aluminum plate, so that the aluminum plate has an improved adhesion to an image recording layer formed thereon and is excellent in press life.

<Third Alkaline Etching Treatment>

The third alkaline etching treatment, which is performed after the second electrolytic treatment, aims at dissolving the smuts generated in the second electrolytic treatment and at dissolving edge portions of the pits which are formed in the second electrolytic treatment. The third alkaline etching treatment is basically similar to the first alkaline etching treatment. Accordingly, only the difference will be described below.

In the third alkaline etching treatment, the etching amount is preferably equal to or above 0.05 g/m$^2$, or more preferably equal to or above 0.1 g/m$^2$. Meanwhile, the etching amount is preferably equal to or below 0.3 g/m$^2$, or more preferably equal to or below 0.25 g/m$^2$. When the etching amount is equal to or above 0.05 g/m$^2$, the edge portions of the pits generated in the second electrolytic treatment in hydrochloric acid are smoothed in a non-image area of the lithographic printing plate and ink is hardly caught by the edge portions. Accordingly, it is possible to achieve excellent stain resistance. In the meantime, when the etching amount is equal to or below 0.3 g/m$^2$, the irregularities generated in the first electrolytic treatment in hydrochloric acid and the second electrolytic treatment in hydrochloric acid are increased in size. Accordingly, it is possible to achieve excellent press life.

In the third alkaline etching treatment, the concentration of the alkaline solution is preferably equal to or above 30 g/L. Meanwhile, in order not to excessively reduce the sizes of the irregularities generated in the precedent alternating current electrolyses in hydrochloric acid, the concentration of the alkaline solution is preferably equal to or below 100 g/L, or more preferably equal to or below 70 g/L.

Moreover, it is preferable that the alkaline solution contain aluminum ions. The aluminum ion concentration is preferably equal to or above 1 g/L, or more preferably equal to or above 3 g/L. Meanwhile, the aluminum ion concentration is preferably equal to or below 50 g/L, or more preferably equal to or below 8 g/L. Such an alkaline solution can be prepared by use of water, a 48-wt % caustic soda aqueous solution, and sodium aluminate, for example.

In the third alkaline etching treatment, the temperature of the alkaline solution is preferably equal to or above 25° C., or more preferably equal to or above 30° C. Meanwhile, the temperature is preferably equal to or below 60° C., or more preferably equal to or below 50° C.

In the third alkaline etching treatment, the treating time is preferably equal to or above 1 second or more preferably equal to or above 2 seconds. Meanwhile, the treating time is preferably equal to or below 30 seconds, or more preferably equal to or below 10 seconds.

<Third Desmutting Treatment>

After performing the third alkaline etching treatment, it is preferable to perform acid washing (a third desmutting treatment) in order to remove stains (smuts) remaining on the surface. The third desmutting treatment is basically similar to the first desmutting treatment. Accordingly, only the difference will be described below.

In the third desmutting treatment, the same type of solution (e.g., sulfuric acid) as the electrolytic solution to be used in the subsequent anodic oxidation treatment is preferably used because a water washing treatment to be performed between the third desmutting treatment and the anodic oxidation treatment can be omitted.

In the third desmutting treatment, it is preferable to use the acidic solution containing an acid in a range of 5 to 400 g/L and aluminum ions in a range of 0.5 to 8 g/L. To be more precise, when using sulfuric acid, it is preferable to use the solution prepared by dissolving aluminum sulfate in a sulfuric acid aqueous solution having the sulfuric acid concentration in a range of 100 to 350 g/L, so as to adjust the aluminum ion concentration to a range of 1 to 5 g/L.

In the third desmutting treatment, the treating time is preferably equal to or above 1 second, or more preferably equal to or above 4 seconds. Meanwhile, the treating time is preferably equal to or below 60 seconds, or more preferably equal to or below 15 seconds.

In the third desmutting treatment, when the same type of solution as the electrolytic solution to be used in the subsequent anodic oxidation treatment is used as a desmutting solution, it is possible to omit draining and a water washing treatment by use of a nip roller after the desmutting treatment.

<Anodic Oxidation Treatment>

The aluminum plate after the above-described treatments is further subjected to the anodic oxidation treatment. The anodic oxidation treatment can be carried out in accordance with a method conventionally practiced in this field. In this case, it is possible to form an anodized film by applying electricity to the aluminum plate as the anode in a solution having the sulfuric acid concentration in a range of 50 to 300 g/L and the aluminum ion concentration equal to or below 5 wt %. As for the solution used in the anodic oxidation treatment, it is possible to use any one of or a combination of sulfuric acid, phosphoric acid, chromic acid, oxalic acid, sulfamic acid, benzensulfonic acid, amidosulfonic acid, and the like.

At this time, at least any components normally contained in the aluminum plate, the electrodes, tap water, underground water, and the like may be contained in the electrolytic solution. Further, second and third components may be added thereto. The second and third components cited herein may be: metal ions of Na, K, Mg, Li, Ca, Ti, Al, V, Cr, Mn, Fe, Co, Ni, Cu, Zn, and the like; positive ions such as ammonium ions; and negative ions such as nitrate ions, carbonate ions, chloride ions, phosphate ions, fluoride ions, sulfite ions, titanate ions, silicate ions, or borate ions, for example. Such components may be contained in a concentration of about 0 to 10000 ppm.

Conditions of the anodic oxidation treatment vary depending on the electrolytic solution to be used and therefore cannot be determined universally. However, in general, it is preferable to use the concentration of the electrolytic solution in a range of 1 to 80 wt %, the temperature of the solution in a range of 5° C. to 70° C., the current density in a range of 0.5 to 60 A/dm$^2$, the voltage in a range of 1 to 100 V, and the time for electrolysis in a range of 15 seconds to 50 minutes. These conditions are appropriately adjusted to form a desired amount of the anodized film.

Meanwhile, it is also possible to apply methods disclosed in JP 54-81133 A, JP 57-47894 A, JP 57-51289 A, JP 57-51290 A, JP 57-54300A, JP 57-136596 A, JP 58-107498 A, JP 60-200256 A, JP 62-136596 A, JP 63-176494 A, JP 4-176897 A, JP 4-280997 A, JP 6-207299 A, JP 5-24377 A, JP 5-32083 A, JP 5-125597 A, and JP 5-195291 A.

Among these methods, as disclosed in JP 54-12853 A and in JP 48-45303 A, it is preferable to use a sulfuric acid solution as the electrolytic solution. The sulfuric acid concentration in the electrolytic solution is preferably in a range of 10 to 300 g/L (1 to 30 wt %), or more preferably in a range of 50 to 200 g/L (5 to 20 wt %). Meanwhile, the aluminum ion concentration is preferably in a range of 1 to 25 g/L (0.1 to 2.5 wt %), or more preferably in a range of 2 to 10 g/L (0.2 to 1 wt %). Such an electrolytic solution can be prepared by adding aluminum sulfate or the like to dilute sulfuric acid having a concentration in a range of 50 to 200 g/L, for example.

The compositions of the electrolytic solution are preferably managed by conductivity, specific gravity and temperature, or, by conductivity, propagation velocity of ultrasonic waves and temperature corresponding to a matrix of the sulfuric acid concentration and the aluminum ion concentration, by using a method as used in the above-described electrolysis in nitric acid.

The temperature of the electrolytic solution is preferably in a range of 25° C. to 55° C., or more preferably in a range of 30° C. to 50° C.

When performing the anodic oxidation treatment in the electrolytic solution containing sulfuric acid, a direct or alternating current may be applied between the aluminum plate and the counter electrodes.

When a direct current is applied to the aluminum plate, the current density is preferably in a range of 1 to 60 A/dm$^2$, or more preferably in a range of 5 to 40 A/dm$^2$.

When performing the anodic oxidation treatment continuously, it is preferable to apply a current at low current density in a range of 5 to 10 A/dm$^2$ in the beginning of the anodic oxidation treatment and then to raise the current density up to a range of 30 to 50 A/dm$^2$ or even higher along with the progress of the anodic oxidation treatment, so as not to cause so-called "burning" (by which the film becomes thicker than surrounding portions) owing to the current which is focused on a part of the aluminum plate.

To be more precise, it is preferable to distribute currents from a direct current power source such that a current from the direct current power source on a downstream side is equal to or higher than a current from the direct current power source on an upstream side. By adopting such current distribution, generation of a so-called burning is suppressed. As a consequence, it is possible to perform the anodic oxidation treatment at a high rate.

When performing the anodic oxidation treatment continuously, it is preferable to carry out a liquid power supply method configured to supply electricity to the aluminum plate through the electrolytic solution.

A porous film provided with numerous holes called pores (micropores) is obtained by performing the anodic oxidation treatment under the conditions described above. Normally, the average pore size thereof is in a range of about 5 to 50 nm, and the average pore density thereof is in a range of about 300 to 800 pcs/μm$^2$.

The quantity of the anodized film is preferably in a range of 1 to 5 g/m$^2$. The plate easily causes flaws when the quantity is below 1 g/m$^2$. On the contrary, when the quantity exceeds 5 g/m$^2$, a large quantity of electricity is required for manufacturing and it is therefore economically disadvantageous. The quantity of the anodized film is more preferably in a range of 1.5 to 4 g/m$^2$. Moreover, it is preferable to perform the anodic oxidation treatment such that a difference in quantity of the anodized film between the central portion and the vicinity of edge portions of the aluminum plate is equal to or below 1 g/m$^2$.

As for an electrolytic apparatus for use in the anodic oxidation treatment, it is possible to use techniques disclosed in JP 48-26638 A, JP 47-18739 A, JP 58-24517 B, and JP 2001-11698 A.

Figure 4:
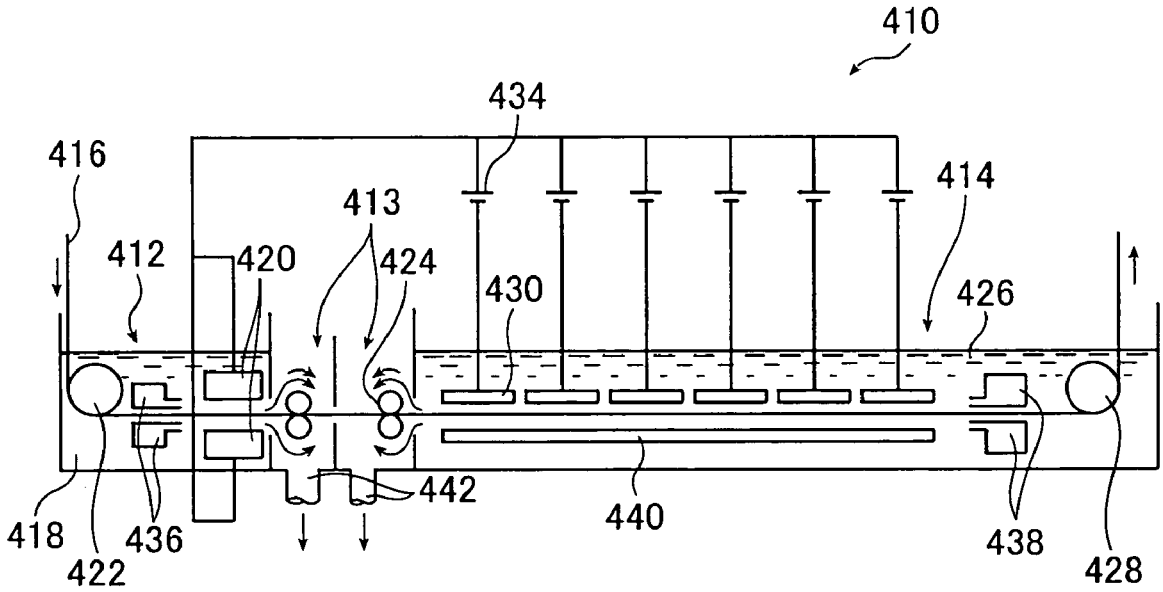
FIG. 4 is a schematic diagram of an anodic oxidation treatment apparatus used in an anodic oxidation treatment in the method of manufacturing a support for a lithographic printing plate of the present invention.

Among these techniques, an apparatus shown in FIG. 4 is preferably used. FIG. 4 is a schematic diagram showing an example of an apparatus configured to perform an anodic oxidation treatment on a surface of an aluminum plate.

In an anodic oxidation apparatus 410 shown in FIG. 4, a power supply tank 412 is disposed on an upstream side in a traveling direction of an aluminum plate 416 and an anodic oxidation treatment tank 414 is disposed on a downstream side in order to supply electricity to the aluminum plate 416 through an electrolytic solution. The aluminum plate 416 is conveyed as indicated by arrows in FIG. 4 by way of path rollers 422 and 428. Anodes 420 which are connected to positive terminals of direct current power sources 434 are disposed in the power supply tank 412 to which the aluminum plate 416 is firstly introduced. Here, the aluminum plate 416 constitutes a cathode. Accordingly, a cathodic reaction takes place on the aluminum plate 416.

Cathodes 430 which are connected to negative terminals of the direct current power sources 434 are disposed in the anodic oxidation treatment tank 414 to which the aluminum plate 416 is subsequently introduced. Here, the aluminum plate 416 constitutes an anode. Accordingly, an anodic reaction takes place on the aluminum plate 416, and the anodized film is formed on the surface of the aluminum plate 416.

Clearance between the aluminum plate 416 and the cathodes 430 is preferably in a range of 50 to 200 mm. Aluminum is used for the cathodes 430. In order to allow hydrogen gas generated in the anodic reaction to escape easily from the system, it is preferable to form the anodes 430 not as electrodes having large areas but as electrodes which are split into multiple pieces along with the traveling direction of the aluminum plate 416.

As shown in FIG. 4, between the power supply tank 412 and the anodic oxidation treatment tank 414, it is preferable to provide a tank called an intermediate tank 413 which drains off an electrolytic solution. By providing the intermediate tank 413, it is possible to suppress bypassing of the current from the anodes 420 to the cathodes 430 instead of passing through the aluminum plate 416. It is preferable to provide nip rollers 424 in the intermediate tank 413 for draining so as to minimize the bypass current. The electrolytic solution removed by draining is discharged from a solution outlet 442 to the outside of the anodic oxidation apparatus 410.

To reduce voltage losses, an electrolytic solution 418 to be stored in the power supply tank 412 has a higher temperature and/or a higher concentration than an electrolytic solution 426 to be stored in the anodic oxidation treatment tank 414. Moreover, compositions, temperatures, and the like of the electrolytic solutions 418 and 426 are determined based on efficiency of formation of the anodized film, shapes of the micropores on the anodized film, hardness of the anodized film, voltages, costs of the electrolytic solutions, and the like.

The electrolytic solutions are supplied to the power supply tank 412 and the anodic oxidation treatment tank 414 by squirting the electrolytic solutions from solution supply nozzles 436 and 438. In order to distribute the electrolytic solution constantly and to prevent local current concentration on the aluminum plate 416 in the anodic oxidation treatment tank 414, the solution supply nozzles 436 and 438 are provided with slits and are thereby configured to stabilize the squirted solutions in the width direction.

In the anodic oxidation treatment tank 414, a shielding plate 440 is provided on an opposite side of the cathodes 430 across the aluminum plate 416. The shielding plate 440 suppresses the current to flow on an opposite side to the surface of the aluminum plate 416 on which the anodized film is to be formed. Clearance between the aluminum plate 416 and the shielding plate 440 is preferably in a range of 5 to 30 mm. It is preferable to use a plurality of direct current power sources 434 while connecting the positive terminals together. In this way, it is possible to control the current distribution in the anodic oxidation treatment tank 414.

<Sealing Treatment>

In the present invention, it is possible to carry out a sealing treatment for sealing the micropores which exist on the anodized film when appropriate. A presensitized plate for a lithographic printing plate having more excellent development property (sensitivity) can be obtained by performing the sealing treatment after the anodic oxidation treatment.

It is widely known that the anodic oxidation film is a porous film provided with numerous small holes called pores in the substantially perpendicular direction to the film surface. In the present invention, it is particularly preferable to subject the porous film to the sealing treatment at high sealing rate. The sealing rate is set preferably equal to or above 50%, more preferably equal to or above 70%, or even more preferably equal to or above 90%. Here, the sealing rate (percent) is defined by the following equation:

Sealing rate=100×(surface area before sealing−surface area after sealing)÷(surface area before sealing)

The above-mentioned surface areas are the values measured by use of the QUANTASORB (made by Yuasa Ionics Co., Ltd.) which adopts the simplified BET mode.

The aluminum plate after the anodic oxidation treatment is further subjected to the sealing treatment and the hydrophilic treatment, and is thereby formed into a more favorable aluminum support for a lithographic printing plate.

The sealing treatment can be carried out by use of publicly known methods such as a hot water treatment, a boiling water treatment, a water vapor treatment, a dichromate treatment, a nitrite treatment, an ammonium acetate treatment, an electrodeposition treatment, or a sodium silicate treatment. It is also possible to use a fluorozirconate treatment as disclosed in JP 36-22063 B and the like. It is also possible to perform the sealing treatment by use of apparatuses and methods disclosed in JP 56-12518 B, JP 4-4194 A, JP 5-202496 A, JP 5-179482 A, and the like. On the other hand, it is possible to use a treatment method using an aqueous solution containing a phosphate and an inorganic fluorine compound as disclosed in JP 9-244227 A. Meanwhile, it is also possible to use a treatment method using an aqueous solution containing a sugar as disclosed in JP 9-134002 A. In addition, it is possible to use treatment methods using an aqueous solution containing titanium and fluorine as disclosed in Japanese Patent Application Nos. 10-252078 and 10-253411. In the meantime, it is also possible to perform a treatment using an alkali metal silicate. In this case, it is possible to use a method disclosed in U.S. Pat. No. 3,181,461 A and the like.

In the alkali metal silicate treatment, it is possible to perform the sealing treatment by using an aqueous solution of an alkali metal silicate having the pH in a range of 10 to 13 at 25° C. which does not cause geletion of the solution and dissolution of the anodic oxidation film, and appropriately selecting the treatment conditions such as the concentration of the alkali metal silicate, the treatment temperature or the treatment time. The preferable alkali metal silicates may include sodium silicate, potassium silicate, lithium silicate, and the like. Moreover, to adjust the pH of the aqueous solution of the alkali metal silicate at a high level, it is possible to combine sodium hydroxide, potassium hydroxide, lithium hydroxide, and the like.

In addition, when appropriate, it is also possible to incorporate alkaline earth metal salts or IVB-group metal salts into the aqueous solution of the alkaline metal silicate. The alkaline-earth metal salts may include nitrate salts such as calcium nitrate, strontium nitrate, magnesium nitrate or barium nitrate, and other water-soluble salts of these alkaline-earth metal elements such as sulfates, hydrochlorides, phosphates, acetates, oxalates or borates thereof. The IVB-group metal salts may include titanium tetrachloride, titanium trichloride, potassium titanium fluoride, potassium titanium oxalate, titanium sulfate, titanium tetraiodide, zirconium oxychloride, zirconium dioxide, zirconium tetrachloride, and the like. It is possible to use the alkaline-earth metal salts and the IVB-group metal salts either independently or in a mixture of two or more salts. These metal salts are preferably used in an amount of 0.01 to 10 wt % or more preferably 0.05 to 5.0 wt %.

The fluorozirconate treatment is another preferable example of the sealing treatment. The fluorozirconate treatment is performed by use of a fluorozirconate salt such as sodium fluorozirconate or potassium fluorozirconate. It is particularly preferable to use an aqueous solution containing sodium fluorozirconate. In this way, it is possible to obtain a presensitized plate having excellent development property (sensitivity) upon exposure and development. In this case, the concentration of the aqueous solution of fluorozirconate salt is set preferably in a range of 0.01 to 2 wt %, or more preferably in a range of 0.1 to 0.3 wt %.

It is more preferable to add sodium dihydrogen phosphate to the aqueous solution of fluorozirconate salt. In this case, the concentration of sodium dihydrogen phosphate is set preferably in a range of 0.01 to 3 wt % or more preferably in a range of 0.1 to 0.3 wt %.

The temperature in the sealing treatment is set preferably in a range of 20° C. to 90° C. or more preferably in a range of 50° C. to 80° C.

The treatment time (dipping time in the aqueous solution) in the sealing treatment is set preferably in a range of 1 to 20 seconds or more preferably in a range of 5 to 15 seconds.

In addition, when appropriate, it is possible to perform other surface treatments after the sealing treatment, such as: a treatment for dipping in an aqueous solution of an alkali silicate such as sodium silicate; a treatment for dipping in a solution containing a polymer or a copolymer including any of a polyvinylphosphonic group, a polyacrylic group, and a sulphonic group on a side chain thereof, or containing an organic compound or its salt including (a) an amino group, and (b) a group selected from the group consisting of a phosphinic group, a phosphonic group and a phosphate group as disclosed in JP 11-231509 A; a treatment for undercoating with the solution; and the like.

Hydrophilic binder polymers used in the hydrophilic layer in the present invention may include: synthetic homopolymers or copolymers such as polyvinyl alcohol, poly(meth) acrylic acid, poly(meth)acrylamide, polyhydroxyethyl (meth)acrylate or polyvinylmethyl ether; natural polymers such as gelatin; and polysaccharides such as dextran, pullulan, cellulose, acacia gum or alginic acid.

Hydrophilic Treatment

A hydrophilic treatment may be carried out after the anodic oxidation treatment or the sealing treatment. The hydrophilic treatment may be a potassium fluorozirconate treatment disclosed in U.S. Pat. No. 2,946,638 A, a phosphomolybdate treatment disclosed in U.S. Pat. No. 3,201,247 A, an alkyl titanate treatment disclosed in GB 1108559 B, a polyacrylic acid treatment disclosed in DE 1091433 B, a polyvinyl phosphonic acid treatment disclosed in DE 1134093 B and in GB 1230447 B, a phosphonic acid treatment disclosed in JP 44-6409 B, a phytic acid treatment disclosed in U.S. Pat. No. 3,307,951, a treatment using a lipophilic polymer compound and a bivalent metal salt disclosed in JP 58-16893 A and JP 58-18291 A, a treatment of providing an undercoating layer of hydrophilic cellulose (such as carboxymethylcellulose) containing a water-soluble metal salt (such as zinc acetate) as disclosed in U.S. Pat. No. 3,860,426, and a treatment of undercoating with a water-soluble polymer having a sulfo group as disclosed in JP 59-101651 A.

It is also possible to perform an undercoating treatment using any of a phosphate disclosed in JP 62 -019494 A, a water-soluble epoxy compound disclosed in JP 62-033692 A, phosphate-modified starch disclosed in JP 62-097892 A, a diamine compound disclosed in JP 63-056498 A, an inorganic or organic amino acid disclosed in JP 63-130391 A, an organic phosphonic acid containing a carboxy group or a hydroxyl group disclosed in JP 63-145092 A, a compound having an amino group and a phosphonic acid group disclosed in JP 63-165183 A, a specific carboxylic acid derivative disclosed in JP 2-316290 A, a phosphate ester disclosed in JP 3-215095 A, a compound having one amino group and one phosphorous oxyacid group disclosed in JP 3-261592 A, an aliphatic or aromatic phosphonic acid such as phenylphosphonic acid disclosed in JP 5-246171 A, a compound having a S atom such as thiosalicylic acid disclosed in JP 1-307745 A, a compound having a phosphorous oxyacid group disclosed in JP 4-282637 A, and the like.

In addition, it is also possible to perform coloring by use of an acidic dye disclosed in JP 60-64352 A.

Moreover, it is preferable to perform the hydrophilic treatment in accordance with a method of dipping the aluminum plate in an aqueous solution of an alkali metal silicate such as sodium silicate or potassium silicate, a method of forming a hydrophilic undercoating layer by applying either a hydrophilic vinyl polymer or a hydrophilic compound, or the like.

The hydrophilic treatment using an aqueous solution of an alkali metal silicate such as sodium silicate or potassium silicate can be performed in accordance with methods and procedures disclosed in U.S. Pat. Nos. 2,714,066 and 3,181,461.

The alkali metal silicate may be a sodium silicate, a potassium silicate, or a lithium silicate, for example. The aqueous solution of the alkali metal silicate may contain an appropriate amount of sodium hydroxide, potassium hydroxide, lithium hydroxide, or the like.

Meanwhile, the aqueous solution of the alkali metal silicate may contain an alkali earth metal salt or a Group 4 (Group IVA) metal salt. The alkali earth metal salt may be: a nitrate such as calcium nitrate, strontium nitrate, magnesium nitrate, barium nitrate; a sulfate; a hydrochloride; a phosphate; an acetate; an oxalate; a borate, for example. The Group 4 (Group IVA) metal salt may be titanium tetrachloride, titanium trichloride, potassium fluorotitanate, potassium titanium oxalate, titanium sulfate, titanium tetraiodide, zirconium oxychloride, zirconium dioxide, and zirconium tetrachloride, for example. These alkali earth metal salts and the Group 4 (Group IVA) metal salts are used either singly or in a combination of two or more types.

The Si amount adsorbed by the alkali metal silicate treatment can be measured by use of an x-ray fluorescence spectrometer, and such an adsorption amount is preferably in a range of about 1.0 to 15.0 $mg/m^2$.

By performing the alkali metal silicate treatment, it is possible to obtain an effect of improving dissolution resistance of the surface of the support for a lithographic printing plate to an alkaline developer, and to suppress dissolution of the aluminum component in the developer. Accordingly, it is possible to reduce generation of development scum attributable to fatigue of the developer.

Meanwhile, the hydrophilic treatment by forming the hydrophilic undercoating layer can be performed in accordance with conditions and procedures disclosed in JP 59-101651 A and JP 60-149491 A.

The hydrophilic vinyl polymer to be used in this method may be polyvinylsulfonic acid, and a copolymer compound of a vinyl polymer compound having a sulfo group such as p-styrene sulfonic acid and a normal vinyl polymer compound such as (meta)acrylate alkyl ester, for example. Meanwhile, the hydrophilic compound to be used in this method may be a compound including at least any one of the group consisting of a —$NH_2$ group, a —COOH group, and a sulfo group, for example.

<Drying>

After the support for a lithographic printing plate is obtained as described above, it is preferable to dry the surface of the support for a lithographic printing plate before providing the image recording layer. It is preferable to perform drying after completing the final process of the surface treatment, the water washing treatment, and draining with the nip roller.

Temperature for drying is preferably equal to or above 70° C., or more preferably equal to or above 80° C. Meanwhile, the temperature is preferably equal to or below 110° C., or more preferably equal to or below 100° C.

The drying time is preferably equal to or above 1 second or more preferably equal to or above 2 seconds. Meanwhile, the drying time is preferably equal to or below 20 seconds, or more preferably equal to or below 15 seconds.

<Management of Compositions of Solutions>

In the present invention, the compositions of the respective treatment solutions used in the above-described surface treatment are preferably managed by a method disclosed in JP 2001-121837 A. It is preferable to prepare multiple samples of the treatment solutions in various concentrations in advance, to measure the propagation velocity of ultrasonic waves regarding two levels of temperature of the respective solutions, and to produce a matrix data table. Moreover, during the treatments, it is preferable to measure the temperature of the solutions and the propagation velocity of ultrasonic waves in real time, and to control the concentrations based on the measurement results. Particularly, when the electrolytic solution having the sulfuric acid concentration equal to or above 250 g/L is used in the desmutting treatment, it is preferable to control the concentration according to the above-described method.

Here, it is preferable that the respective electrolytic solutions used in the electrolytic surface roughening treatments and in the anodic oxidation treatment have a Cu concentration equal to or below 100 ppm. When the Cu content is too high, Cu is deposited on the aluminum plate when a production line is stopped. In this case, the deposited Cu is transferred to the path rollers when the production line is restarted and may cause uneven treatments.

It is further preferable to perform a well known hydrophilic treatment after the sealing treatment.

(Presensitized Plate)

The support for a lithographic printing plate obtained by the present invention can be formed into a presensitized plate of the present invention by providing the image recording layer. A photosensitive composition is used in the image recording layer.

The photosensitive composition suitable for use in the present invention may be a thermal positive photosensitive composition containing an alkali-soluble polymer compound and a photothermal conversion material (this composition and an image recording layer using this composition will be hereinafter referred to as a "thermal positive type"), a thermal negative photosensitive composition containing a setting compound and a photothermal conversion material (hereinafter similarly referred to as a "thermal negative type"), a photopolymerization type photosensitive composition (hereinafter similarly referred to as a "photopolymer type"), a negative photosensitive composition containing diazo resin or a photocrosslinkable resin (hereinafter similarly referred to as a "conventional negative type"), a positive photosensitive composition containing a quinone diazide compound (hereinafter similarly referred to as a "conventional positive type"), and a photosensitive composition which does not require a special developing process (hereinafter similarly referred to as a "non-treatment type"), for example. Now, these suitable photosensitive compositions will be described below.

<Thermal Positive Type>

<Photosensitive Layer>

The thermal positive type photosensitive composition contains an alkali-soluble polymer compound and a photothermal conversion material. On the image recording layer of the thermal positive type, the photothermal conversion material converts light energy as from an infrared laser into heat, and the heat efficiently cancels an interaction which is reducing alkali solubility of the alkali-soluble polymer compound.

The alkali-soluble polymer compound may be resin having an acidic group in the molecule thereof, and a mixture of two or more types of such resin, for example. Particularly, it is preferable to use resin having an acidic group such as a phenylic hydroxy group, a sulfonamide group (—$SO_2NH$—R(R in the formula represents a hydrocarbon group)), or an active imino group (—$SO_2NHCOR$, —$SO_2NHSO_2R$, or —$CONHSO_2R$(R in the respective formulae is as defined above)), for example, in light of solubility to the alkaline developer.

Among these materials, the resin having a phenylic hydroxy group is preferred in light of excellent image formation property by exposure to the light as from an infrared laser. The suitable resin having a phenylic hydroxy group may be novolac resin such as phenyl formaldehyde resin, m-cresol formaldehyde resin, p-cresol formaldehyde resin, or m-/p-mixed cresol formaldehyde resin, phenyl/cresol-mixed (any of m-, p-, and m-/p-mixed types are acceptable) formaldehyde resin (phenyl-cresol-formaldehyde cocondensed resin).

In addition, a polymer compound disclosed in JP 2001-305722 A (paragraph numbers from [0023] to [0042], in particular), a polymer compound disclosed in JP 2001-215693 A which has a repeating unit expressed by a general formula (1), and a polymer compound disclosed in JP 2002-311570 A (paragraph number [0107], in particular) are also suitable.

In light of recording sensitivity, the suitable examples of the photothermal conversion material include pigments and dyes having a light absorption range in the infrared wavelength range of 700 to 1200 nm. The preferable dyes may include a azo dye, a metal complex salt azo dye, a pyrazolone azo dye, a naphthoquinone dye, an anthraquinone dye, a phthalocyanine dye, a carbonium dye, a quinoneimine dye, a methine dye, a cyanine dye, a squalirium dye, a pyrilium salt, and a metal thiolate complex (such as nickel thiolate complex). Among these materials, a cyanine dye is particularly preferred. More specifically, a cyanine dye expressed by a general formula (I) in JP 2001-305722 A is preferred.

The thermal positive type photosensitive composition may contain a dissolution blocker. The preferable dissolution blockers may include those disclosed in paragraph numbers from [0053] to [0055] in JP 2001-305722 A, for example.

Moreover, it is preferable that the thermal positive type photosensitive composition contain additives including a sensitivity adjuster, a printing agent for obtaining a visible image immediately after heating by light exposure, a compound such as a dye as an image coloring agent, and a surfactant for improving a coating property and treatment stability. As for these additives, compounds disclosed in paragraph numbers from [0056] to [0060] in JP 2001-305722 A are preferred.

The photosensitive compositions described in detail in JP 2001-305722 A are preferably used for other purposes as well.

Moreover, the image recording layer of the thermal positive type is not limited to a single layer type, and a two-layer type structure is also applicable.

A preferable image recording layer of a two-layer structure (a duplex type image recording layer) is a type in which a lower layer having excellent press life and solvent resistance (hereinafter referred to a "layer A") is provided on a side close to the support and a layer having an excellent positive image formation property (hereinafter referred to as a "layer B") is provided thereon. This type has high sensitivity and can therefore achieve wide development latitude. The layer B generally includes a photothermal conversion material. The aforementioned dyes are suitable for the photothermal conversion material.

As for the resin to be used in the layer A, a polymer containing a monomer having a sulfonamide group, an active imino group, a phenyl hydroxy group or the like as a copolymer component is preferred in terms of excellent press life and solvent resistance. As for the resin to be used in the layer B, a resin soluble in an alkaline aqueous solution and having a phenylic hydroxy group is preferred.

In addition to the above-described resin, the compositions used in the layer A and the layer B may contain other various additives when appropriate. To be more precise, various additives disclosed in paragraph numbers from [0062] to [0085] in JP 2002-3233769 A are preferably used. Moreover, the above-described additives disclosed in the paragraph numbers from [0053] to [0060] in JP 2001-305722 A are preferably used as well.

The respective components constituting the layer A and the layer B, and the contents thereof are preferably controlled as disclosed in JP 11-218914 A.

<Intermediate Layer>

It is preferable to provide an intermediate layer between the image recording layer of the thermal positive type and the support. As the components to be contained in the intermediate layer, it is preferable to use various organic compounds disclosed in paragraph number [0068] in JP 2001-305722 A.

Others

As a method of manufacturing the image recording layer of the thermal positive type and a plate making method, it is possible to use methods described in detail in JP 2001-305722 A.

<Thermal Negative Type>

The thermal negative type photosensitive composition contains a setting compound and a photothermal conversion material. The image recording layer of the thermal negative type is a negative photosensitive layer in which a portion irradiated with light such as infrared laser light is cured to form an image area.

<Polymerization Layer>

One preferable image recording layer of the thermal negative type is a polymerization type image recording layer (a polymerization layer). The polymerization layer contains the photothermal conversion material, a radical generator, a radical polymerizable compound which is a setting compound, and a binder polymer. In the polymerization layer, the photothermal conversion material converts the absorbed infrared rays into heat, then the heat decomposes the radical generator to generate a radical, and the radical polymerizable compound is brought into a chain reaction by the generated radical and is thereby cured.

The photothermal conversion material may be the photothermal conversion material to be used in the above-described thermal positive type, for example. Particularly preferable examples of the cyanine dyes are disclosed in paragraph numbers from [0017] to [0019] in JP 2001-133969 A.

Onium salt is preferred as the radical generator. Particularly, onium salt disclosed in paragraph numbers from [0030] to [0033] in JP 2001-133969 A are preferred.

The radical polymerizable compound may be a compound having at least one or preferably two or more terminal ethylenically unsaturated bonds.

Linear organic polymers are preferred as the binder polymer. Specifically, linear organic polymers having solubility or a swelling property with respect to water or a weakly alkaline water are preferred. Among such polymers, (meta) acrylic resin with a side chain having either an unsaturated group typified by an allyl group and an acryloyl group or a benzyl group, and, a carboxy group, is preferred in light of an excellent balance between film strength, sensitivity, and a development property.

Concerning the radical polymerizable compound and the binder polymer, it is possible to use materials described in detail in paragraph numbers from [0036] to [0060] in JP 2001-133969 A.

It is preferable that the thermal negative type photosensitive composition contain additives (such as a surfactant for improving a coating property) disclosed in paragraph numbers from [0061] to [0068] in JP 2001-133969 A.

As a method of manufacturing the polymerization layer and a plate making method, it is possible to use methods described in detail in JP 2001-133969 A.

<Acid Crosslink Layer>

Moreover, an acid crosslink type image recording layer (an acid cross link layer) is also preferred as another image recording layer of the thermal negative type. The acid crosslink layer contains a photothermal conversion material, a thermal acid generator, an acid-crosslinkable compound (a crosslinking agent) which is a setting compound, and an alkali-soluble polymer compound which can react with the crosslinking agent in the presence of acid. In the acid crosslink layer, the photothermal conversion material converts the absorbed infrared rays into heat, then the heat decomposes the thermal acid generator to generate an acid, and the generated acid causes a reaction between the crosslinking agent and the alkali-soluble polymer compound for curing.

Those materials used in the polymerization layer may be used for the photothermal conversion material.

The thermal acid generator may be a thermal decomposition compound such as a photoinitiator for photopolymerization, a color-turning agent for pigments, or an acid generator used for micro resist.

The crosslinking agent may be: an aromatic compound substituted by a hydroxymethyl group or an alkoxymethyl group; a compound having an N-hydroxymethyl group, an N-alkoxymethyl group or an N-acyloxymethyl group; and an epoxy compound, for example.

The alkali-soluble polymer compound may be novolac resin or a polymer with a side chain having a hydroxyaryl group, for example.

<Photopolymer Type>

The photopolymerization type photosensitive composition includes an addition polymerizable compound, a photopolymerization initiator, and a high molecular weight binder.

The preferable addition polymerizable compound may be an ethylenically unsaturated bond-containing compound which is addition polymerizable. The ethylenically unsaturated bond-containing compound is a compound having a terminal ethylenically unsaturated bond. To be more precise, the ethylenically unsaturated bond-containing compound has various chemical aspects such as a monomer, a prepolymer, and a mixture thereof, for example. The monomer may be an ester of an unsaturated carboxylic acid (such as acrylic acid, methacrylic acid, itaconic acid or maleic acid) and an aliphatic polyvalent alcohol compound, and an amide of an unsaturated carboxylic acid and an aliphatic polyvalent amine compound.

Moreover, a urethane addition polymerizable compound is also preferred as the addition polymerizable compound.

The photopolymerization initiator can be selected from among various photopolymerization initiators or a combined system of two or more photopolymerization initiators (a photopolymerization initiating system) as appropriate depending on a wavelength of a light source used. For example, initiating systems disclosed in paragraph numbers from [0021] to [0023] in JP 2001-22079 A are preferred.

The high molecular weight binder is supposed not only to function as a film forming agent for the photopolymerization type photosensitive composition but also to dissolve the image recording layer in the alkaline developer. Accordingly, an organic high molecular weight polymer having solubility or a swelling property with respect to an alkaline water is used therein. As the organic high molecular weight polymer, materials disclosed in paragraph numbers from [0036] to [0063] in JP 2001-22079 A are preferred.

It is preferable that the photopolymerization type photosensitive composition of the photopolymer type contain additives (including a surfactant for improving a coating property, a colorant, a plasticizer, and a thermal polymerization inhibitor, for example) disclosed in paragraph numbers from [0079] to [0088] in JP 2001-22079 A.

Moreover, it is preferable to provide an oxygen impermeable protection layer on the image recording layer of the photopolymer type in order to prevent a polymerization inhibition effect of oxygen. A polymer to be contained in the oxygen impermeable protection layer may be polyvinyl alcohol and a copolymer thereof, for example.

In addition, it is also preferable to provide an intermediate layer or an adhesive layer as disclosed in paragraph numbers from [0124] to [0165] in JP 2001-228608 A.

<Conventional Negative Type>

The photosensitive composition of the conventional negative type contains diazo resin or photocrosslinkable resin. In particular, a photosensitive composition containing diazo resin and a polymer (a binder) having solubility or a swelling property with respect to an alkali is preferred.

The diazo resin may be: a condensate of an aromatic diazonium salt and an active carbonyl group-containing compound such as formaldehyde; and an organic solvent-soluble diazo resin inorganic salt which is a reaction product between a condensate of a p-diazophenylamine and formaldehyde, and, any of a hexafluorophosphate or a tetrafluoroborate, for example. Particularly, a high molecular weight diazo compound containing not less than 20 mol % of a hexamer or larger as disclosed in JP 59-78340 A is preferred.

The binder may be a copolymer which contains any of acrylic acid, methacrylic acid, crotonic acid, and maleic acid as an essential component, for example. To be more precise, the binder may be a multi-copolymer of monomers such as 2-hydroxyethyl (meta)acrylate, (meta)acrylonitrile or (meta) acrylic acid as disclosed in JP 50-118802 A, or a multi-copolymer including alkyl acrylate, (meta)acrylonitrile, and an unsaturated carboxylic acid as disclosed in JP 56-4144 A.

It is preferable that the photosensitive composition of the conventional negative type contain compounds disclosed in paragraph numbers from [0014] to [0015] in JP 7-281425 A such as a printing agent, a dye, a plasticizer for providing the coating with flexibility and abrasion resistance or a development accelerator, and a surfactant for improving a coating property, as additives.

Below the photosensitive layer of the conventional negative type, it is preferable to provide an intermediate layer disclosed in JP 2000-105462 A, which contains a polymer compound including a constituent having an acid radical and a constituent having an onium group.

<Conventional Positive Type>

The photosensitive composition of the conventional positive type contains a quinone diazide compound. In particular, a photosensitive composition containing an o-quinone diazide compound and an alkali-soluble polymer compound is preferred.

The o-quinone diazide compound may be an ester of 1,2-naphtoquinone-2-diazide-5-sulfonyl chloride and any of phenyl-formaldehyde resin and cresol-formaldehyde resin, or an ester of 1,2-naphtoquinone-2-diazide-5-sulfonyl chloride and pyrogallol-acetone resin disclosed in U.S. Pat. No. 3,635,709, for example.

The alkali-soluble polymer compound may be phenyl-formaldehyde resin, cresol-formaldehyde resin, phenyl-cresol-formaldehyde cocondensed resin, polyhydroxystyrene, an N-(4-hydroxyphenyl)methacrylamide copolymer, a carboxy group-containing polymer disclosed in JP 7-36184 A, phenylic hydroxy group-containing acrylic resin disclosed in JP 51-34711 A, sulfonamide group-containing acrylic resin disclosed in JP 2-866 A, or urethane resin, for example.

It is preferable that the photosensitive composition of the conventional positive type contain compounds disclosed in paragraph numbers from [0024] to [0027] in JP 7-92660 A such as a sensitivity adjuster, a printing agent or a dye, and a surfactant disclosed in paragraph number [0031] in JP 7-92660 A for improving a coating property, as additives.

Below the photosensitive layer of the conventional positive type, it is preferable to provide an intermediate layer which is similar to the above-described intermediate layer preferably used in the conventional negative type.

<Non-treatment Type>

The photosensitive composition of the non-treatment type includes thermoplastic fine-particle polymer type, a microcapsule type, a sulfonic acid generating polymer containing type. All of these are included in the thermosensitive type containing the photothermal conversion material. It is preferable that the photothermal conversion material be a dye similar to the one used in the above-described thermal positive type.

The photosensitive composition of the thermoplastic fine-particle polymer type is formed by dispersing a hydrophobic and thermofusible fine-particle polymer in a hydrophilic polymer matrix. On an image recording layer of the thermoplastic fine-particle polymer type, hydrophobic polymer fine particles are fused by heat generated through light exposure and bond together to form a hydrophobic area, namely, the image area.

As for the fine particle polymer, it is preferable that the fine particles be fused by heat to cohere and have a hydrophilic surface so that the polymer can be dispersed in a hydrophilic component such as a fountain solution. To be more precise, thermoplastic fine-particle polymers disclosed in Research Disclosure No. 33303 (January 1992), JP 9-123387 A, JP 9-131850 A, JP 9-171249 A, JP 9-171250 A, EP 931647 A, and the like are preferred. Among these polymers, polystyrene and methyl polymethacrylate are preferred. The fine-particle polymer having the hydrophilic surface may be: a polymer which is hydrophilic by nature; a fine-particle polymer modified to be hydrophilic by attaching a hydrophilic compound such as polyvinyl alcohol or polyethylene glycol onto a surface thereof, for example.

It is preferable that the fine-particle polymer have a reactive functional group.

Preferable photosensitive compositions of the microcapsule type include a composition as disclosed in JP 2000-118160 A and a composition of the microcapsule type that includes a compound having a heat-reactive functional group as disclosed in JP 2001-277740 A.

The sulfonic acid generating polymer used in the photosensitive composition of the sulfonic acid generating polymer containing type may be a polymer with a side chain having any of a sulfonic ester group, disulfone group, and sec- or tert-sulfonamide group as disclosed in JP 10-282672 A, for example.

By combining hydrophilic resin with the photosensitive composition of the non-treatment type, the development property on a printing machine is improved; and moreover, film strength of the photosensitive layer is also enhanced. As for the hydrophilic resin, it is preferable to use resin having a hydrophilic group such as a hydroxy group, a carboxy group, hydroxyethyl group, a hydroxypropyl group, an amino group, an aminoethyl group, an aminopropyl group or a carboxymethyl group, or hydrophilic sol-gel conversion binder resin, for example.

The image recording layer of the non-treatment type can be developed on a printing machine without requiring a special developing process. As a method of manufacturing the image recording layer of the non-treatment type and a plate making method, it is possible to use methods described in detail in JP 2002-178655 A.

<Back Coating>

It is possible to provide a covering layer made of an organic polymer on a rear surface of the presensitized plate of the present invention obtained by providing a variety of image recording layers on the support for a lithographic printing plate of the present invention as appropriate, in order to prevent scratches on the image recording layer which may be caused by stacking.

(Plate Making Method (Method of Manufacturing Lithographic Printing Plate))

The presensitized plate using the support for a lithographic printing plate obtained by the present invention will be further formed into a lithographic printing plate in accordance with various treatment methods depending on the image recording layer.

A light source for an active light beam for use in image exposure may be a mercury lamp, a metal halide lamp, a xenon lamp, or a chemical lamp, for example. A laser beam may be a helium-neon laser (a He—Ne laser), an argon laser, a krypton laser, a helium-cadmium laser, a KrF excimer laser, a semiconductor laser, an yttrium-aluminum-garnet (YAG) laser, or an yttrium-aluminum-garnet second-harmonic-generation (YAG-SHG) laser, for example.

When the image recording: layer is any of the thermal positive type, the thermal negative type, the conventional negative type, the conventional positive type, and the photopolymer type, it is preferable to obtain the lithographic printing plate by developing the image recording layer using a developer after the light exposure.

The developer is preferably an alkaline developer or more preferably an alkaline aqueous solution which substantially contains no organic solvent.

Moreover, a developer which substantially contains no alkali metal silicate is also preferred. As a developing method using a developer substantially containing no alkali metal silicate, it is possible to use a method described in detail in JP 11-109637 A.

It is also possible to use a developer which contains an alkali metal silicate.

EXAMPLES

Now, the present invention will be described concretely based on examples. It is to be noted, however, that the present invention is not limited only to the following examples.

1. Manufacturing Roll for Metal Rolling and Embossing Aluminum Plate Using Roll

Example 1

A roll having SKD 11 components and a buffed surface was subjected to quenching to adjust Hs to 85. This roll was subjected to degreasing and water washing, and further to surface roughening in accordance with the following procedures.

(1) Surface Roughening in Sulfuric Acid Aqueous Solution

Surface roughening was performed in a solution containing 300 g/L of sulfuric acid (containing 0.5 g/L of iron ions added in the form of iron sulfate) at 50° C., while using the roll as the anode by applying a direct current having the ripple rate of 3% and under conditions of the current density of 800 A/dm$^2$ and the quantity of electricity of 1000 C/dm$^2$.

Carbon was used as the counter electrode. The roll was placed vertically in the electrolytic solution, and the carbon electrode was placed cylindrically so as to surround the roll. A shaft portion of the roll was masked with polyvinyl chloride resin so as to avoid the electrolysis on that part.

After the electrolysis, the roll was subjected to desmutting by dipping the roll in a sulfuric acid electrolytic solution for 40 seconds. Then, the roll was further subjected to water washing and drying.

The average surface roughness Ra on the surface of this roll was 0.6 μm.

(2) Hard Chromium Plating Treatment

The following plating treatments were performed in an electrolytic solution containing 300 g/L of chromic acid (containing 1 g/L of trivalent chromium), 3 g/L of sulfuric acid and 2 g/L of iron at 50° C.

(Reverse Electrolytic Treatment)

The reverse electrolytic treatment was performed for activating the surface and facilitating uniform generation of the plating. The electrolytic treatment using the roll as the anode was performed for 10 seconds at the current density of 30 A/dm$^2$ while applying a continuous direct current. As for the current waveform, a direct current subjected to three-phase full-wave rectification having the ripple rate of 1% was used therein. Lead was used as the counter electrode. The roll was placed vertically in the electrolytic solution, and the lead electrode was placed cylindrically so as to surround the roll. The shaft portion of the roll was masked with polyvinyl chloride resin so as to avoid the electrolysis on that part.

(Plating Treatment)

The plating treatment was performed in the electrolytic solution while using the power source of the reverse polarity.

The plating treatment using the roll as the cathode was performed at the current density of 60 A/dm$^2$ while applying a continuous direct current until the plating thickness reached 7 μm. As for the current waveform, a direct current subjected to three-phase full-wave rectification having the ripple rate of 1% was used therein. Lead was used as the counter electrode. The roll was placed vertically in the electrolytic solution, and the lead electrode was placed cylindrically so as to surround the roll. The shaft portion of the roll was masked with polyvinyl chloride resin so as to avoid the electrolysis on that part.

The average surface roughness Ra on the surface of this roll after the plating was 0.5 μm (this roll will be abbreviated as Roll 1).

Example 2

A roll having SKD 11 components and a buffed surface was subjected to quenching to adjust Hs to 85. This roll was subjected to degreasing and water washing, and further to surface roughening in accordance with the following procedures.

(1) Surface Roughening in Nitric Acid Aqueous Solution

Surface roughening was performed in a solution containing 120 g/L of nitric acid with addition of 100 g/L of sodium nitrate (containing 0.1 g/L of iron ions added in the form of iron nitrate) at 50° C., while using the roll as the anode by applying a direct current having the ripple rate of 3% and under conditions of the current density of 80 A/dm$^2$ and the quantity of electricity of 6000 C/dm$^2$.

Carbon was used as the counter electrode. The roll was placed vertically in the electrolytic solution, and the carbon electrode was placed cylindrically so as to surround the roll. A shaft portion of the roll was masked with polyvinyl chloride resin so as to avoid the electrolysis on that part.

After the electrolysis, the roll was subjected to water washing and drying, and then to desmutting by dipping the roll in a sulfuric acid electrolytic solution for 40 seconds. Then, the roll was again subjected to water washing and drying.

(2) Hard Chromium Plating Treatment

The plating treatments similar to the reverse electrolytic treatment and the plating treatment in Example 1 were performed, except that an electrolytic solution, which contains 300 g/L of chromic acid (containing 3 g/L of trivalent chromium), 2 g/L of sulfuric acid and 1 g/L of iron and has fluid temperature of 50° C., was used instead.

The average surface roughness Ra on the surface of this roll after the plating was 0.8 μm (this roll will be abbreviated as Roll 2).

Example 3

A roll having SKD 11 components and a buffed surface was subjected to quenching to adjust Hs to 85. This roll was subjected to degreasing and water washing, and further to surface roughening in accordance with the following procedures.

(1) Surface Roughening in Hydrochloric Acid Aqueous Solution

Surface roughening was performed in a solution containing 100 g/L of iron chloride at 50° C., while using the roll as the anode by applying a direct current having the ripple rate of 3% and under conditions of the current density of 50 A/dm$^2$ and the quantity of electricity of 1000 C/dm$^2$.

Carbon was used as the counter electrode. The roll was placed vertically in the electrolytic solution, and the carbon electrode was placed cylindrically so as to surround the roll. A shaft portion of the roll was masked with polyvinyl chloride resin so as to avoid the electrolysis on that part.

After the electrolysis, the roll was subjected to water washing and drying, and then to desmutting by dipping the roll in a sulfuric acid electrolytic solution for 40 seconds. Then, the roll was again subjected to water washing and drying.

The average surface roughness Ra on the surface of this roll was 0.7 μm.

(2) Hard Chromium Plating Treatment

The plating treatments similar to the reverse electrolytic treatment and the plating treatment in Example 1 were performed, except that an electrolytic solution, which contains 250 g/L of chromic acid (containing 5 g/L of trivalent chromium), 2.5 g/L of sulfuric acid and 0.5 g/L of iron and has fluid temperature of 50° C., was used instead.

The average surface roughness Ra on the surface of this roll after the plating was 0.6 μm (this roll will be abbreviated as Roll 3).

Profiles of the surfaces of these rolls were observed in accordance with the replica method. The levels of the peaks on the surfaces of the rolls were well regulated.

Example 4

The following treatments were performed by use of a roll made of tool steel (SKD 11) and subjected to quenching to adjust Hv to 750.

(1) Buffing Treatment

The buffing treatment was performed to remove traces of a grindstone used for polishing the surface of the roll. The surface roughness Ra was 0.2 μm and the Rmax was 1 μm.

(2) Degreasing Treatment of Roll

Grease on the surface was removed by use of a degreasing solution by dipping the roll in a degreasing tank adjusted to the solution temperature of 30° C. for 30 seconds. Thereafter, the roll was subjected to water washing, and the water was removed off by spraying air thereon.

(3) Electrolytic Treatment in Electrolytic Solution while Using Roll as Anode

An electrolytic treatment was performed in an electrolytic solution containing 300 g/L of chromic acid, 2 g/L of sulfuric acid and 1 g/L of iron at the solution temperature of 50° C. by using the roll as the anode at the current density of 30 A/dm$^2$ while applying a continuous direct current. As for the current waveform, a direct current subjected to three-phase full-wave rectification and passed through a filter circuit so as to set the ripple component equal to or below 5% was used therein. The quantity of electricity was varied as shown in Table 1, whereby rolls corresponding to Examples 4-1,4-2, and 4-3 were fabricated (these rolls will be abbreviated as Rolls 4, 5, and 6, respectively). Lead was used as the counter electrode. Each of the rolls was placed vertically in the electrolytic solution, and the lead electrode was placed cylindrically so as to surround the roll. The shaft portion of each of the rolls was masked with polyvinyl chloride resin so as to avoid the electrolysis on that part.

(4) Hard Chromium Plating Treatment

Subsequently, a plating treatment was performed in the electrolytic solution containing 300 g/L of chromic acid, 2 g/L of sulfuric acid and 1 g/L of iron at the solution temperature of 50° C. by using each of the rolls as the cathode at the current density of 60 A/dm$^2$ while applying a continuous direct current. As for the current waveform, the direct current subjected to three-phase full-wave rectification and passed through the filter circuit so as to set the ripple component equal to or below 5% was used therein. The plating time was set appropriately so that every roll had the plating thickness of 6 μm. Lead was used as the counter electrode. Each of the rolls was placed vertically in the electrolytic solution, and the lead electrode was placed cylindrically so as to surround the roll. The shaft portion of each of the rolls was masked with polyvinyl chloride resin so as to avoid the electrolysis on that part.

TABLE 1

| Physical properties of roll surface | | | | | | | | | |
|---|---|---|---|---|---|---|---|---|---|
| | Electricity for | Physical properties of surfaces after electrolysis | | | | Physical properties of surfaces after chromium plating | | | |
| Roll Number | electrolysis C/dm$^2$ | Ra (μm) | Rmax (μm) | Sm (μm) | Δa (deg) | Ra (μm) | Rmax (μm) | Sm (μm) | Δa (deg) |
| Example 44 | 10000 | 0.9 | 10 | 150 | 12 | 0.7 | 7 | 130 | 8 |
| Example 45 | 15000 | 1.1 | 11 | 125 | 14.5 | 0.9 | 8 | 100 | 11 |
| Example 46 | 18000 | 1.4 | 12 | 80 | 16.3 | 1.2 | 9 | 60 | 13 |

Profiles of the surfaces of these rolls were observed in accordance with the replica method. The levels of the peaks on the surfaces of the rolls were well regulated.

2. Evaluation of Cross Sections of Rolls (Numbers of Peaks on Cross Sections of Roll Depending on Respective Slice Levels)

Figure 8:
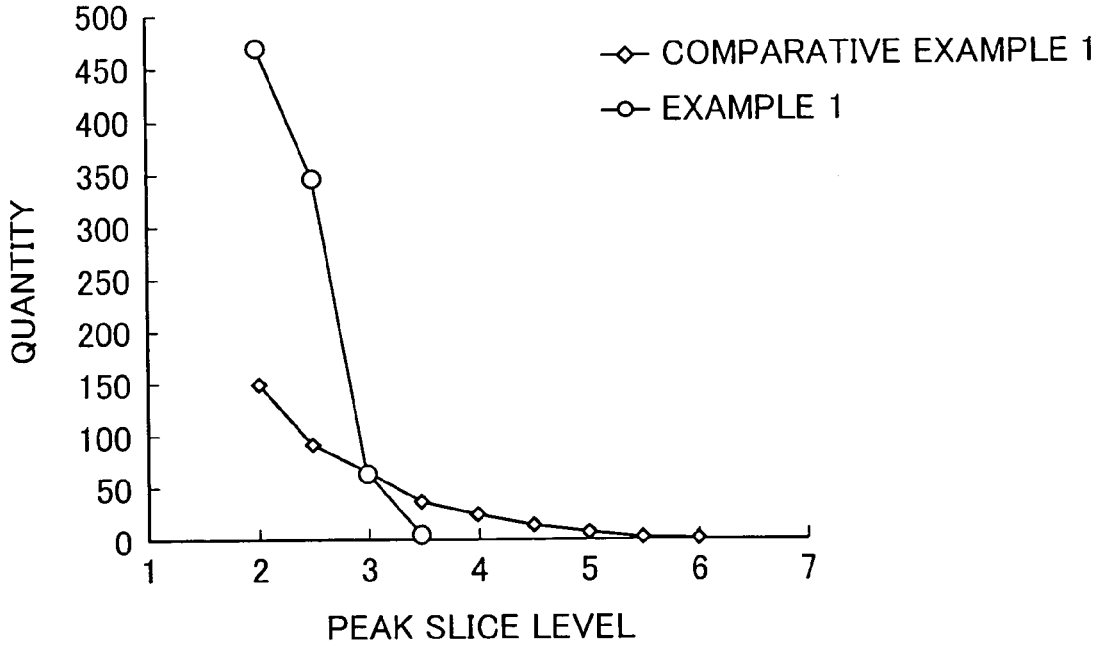
FIG. 8 is a graph showing measurement results of the number of peaks in terms of respective slice levels of cross sections of a roll obtained in Example 1 and of a roll obtained in Comparative Example 1.
Figure 8:
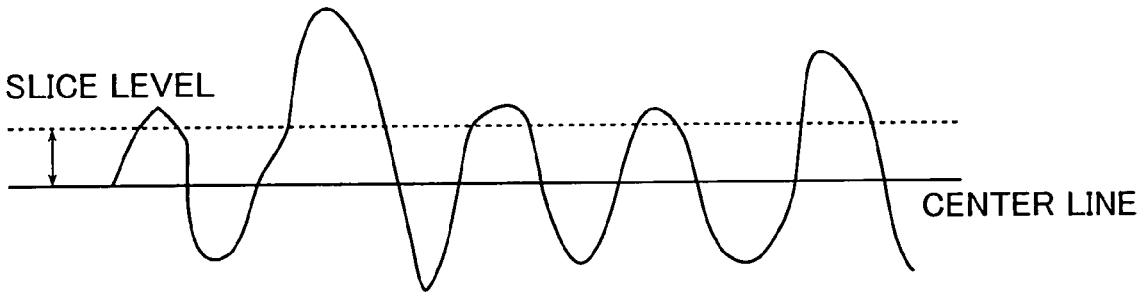

The number of the peaks on cross sections of the roll (Roll 1) obtained in Example 1 and of the roll (Roll C1) obtained in Comparative Example 1 to be described later depending on respective slice levels are shown in FIG. 8. The Micromap Sx520 made by Ryoka Systems Inc. was used for the measurement. Data was produced by slicing three-dimensional data depending on the levels from the center line in the level direction, and the numbers of the peaks intersecting the sliced surfaces in a measurement area of a 400-μm square were measured. Indicators 1 to 7 along the lateral axis in FIG. 8 represent the slice levels of the peaks, and the center line indicates the level 0.

(Cross-sectional Profile Data)

Figure 9:
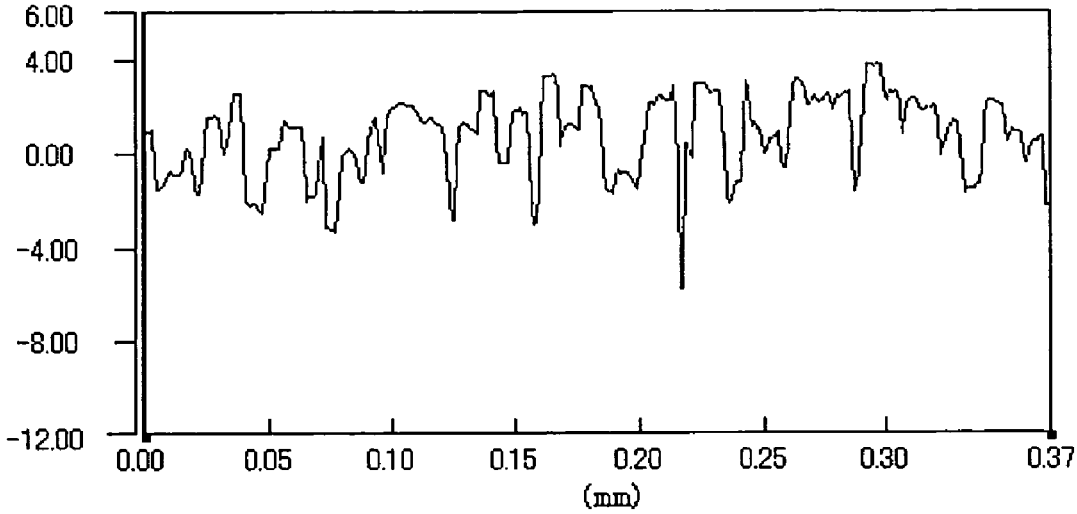
FIG. 9 shows cross-sectional profile data of a roll obtained in 4-2 of Example 4.
Figure 10:
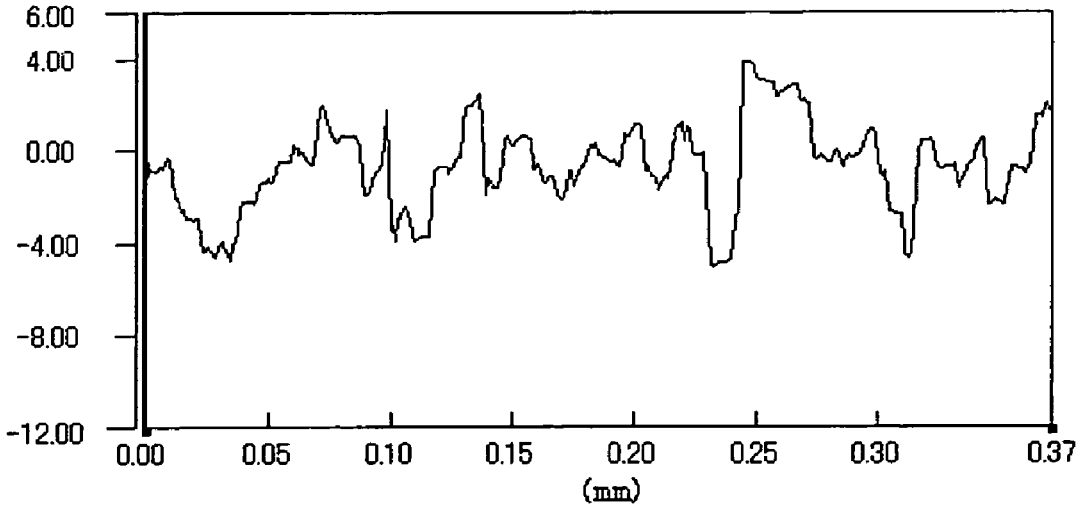
FIG. 10 shows cross-sectional profile data of a roll obtained in Comparative Example 2.

Cross-sectional profile data of the roll (Roll 5) obtained in Example 4-2 and of the roll (Roll C2) obtained in Comparative Example 2 to be described later are shown in FIG. 9 and FIG. 10, respectively. The Micromap 520 made by Ryoka Systems Inc. was used for the measurement. The irregularities positioned on a longitudinal cross section of the roll obtained in Example 4-2 were measured and indicated in the chart.

Example 5

The rolls fabricated in Examples 1 to 3 and 4-2 (Rolls 1, 2, 3, and 5, respectively) were used for the rolling (transfer) treatment on the aluminum plates having the compositions shown in Table 2, whereby the irregularities were provided on the surfaces of the aluminum plates (this process will be abbreviated as Rolling Process 1, and the processed plates obtained will be abbreviated as Plates 1-1, 2-1, 3-1, and 5-1, respectively).

TABLE 2

| Aluminum Composition | | | | | | | | | |
|---|---|---|---|---|---|---|---|---|---|
| | Component | | | | | | | | |
| | Si | Fe | Cu | Mn | Mg | Cr | Zn | Ti | Al |
| wt % | 0.073 | 0.27 | 0.1 | 0 | 0 | 0.001 | 0.003 | 0.002 | balance |

The thickness of these aluminum plates was 0.3 mm and the Ra values were as shown in Table 3. Concerning the aluminum plate rolled by the roll obtained in Example 4-2, the Ra was 0.65 μm, the Rmax was 5.7 μm, the Sm was 70 μm, and the Δa was 7.5 degrees.

Upon the measurement in Examples and Comparative Examples, two-dimensional roughness measurement was conducted by use of the probe-type roughness measuring instrument (the "sufcom 575" made by Tokyo Seimitsu Co. Ltd.), and the arithmetic average roughness Ra defined in ISO 4287 was measured five times and an average value of the measured values was defined as the average roughness Ra. The maximum level Rmax (Ry) concerning the standard length, the average interval of irregularities (the average value within the standard length) Sm, and the average inclination pitch Δa were measured similarly.

(Measurement Conditions)

Cutoff value 0.8 mm, Inclination correction FLAT-ML, Measured length 3 mm, Longitudinal magnification 1000×, Scanning speed 0.3 mm/sec, Probe end diameter 2 μm.

TABLE 3

| Ra of aluminum plates after transfer | | |
|---|---|---|
| Aluminum plates after transfer of irregularities | Rolls | Ra of aluminum plates after transfer (μm) |
| Example 5 1-1 | fabricated in Example 1 | 0.45 |
| Example 5 2-1 | fabricated in Example 2 | 0.60 |
| Example 5 3-1 | fabricated in Example 3 | 0.50 |
| Example 5 5-1 | fabricated in Example 4-2 | 0.65 |

3. Fabrication of Support for Lithographic Printing Plate

The support for a lithographic printing plate was formed by subjecting each of the above-described aluminum plates to the following treatments sequentially (the surface treatment described below will be abbreviated as Surface Treatment 1).

(Surface Treatment)

<1> Etching Treatment in Alkaline Aqueous Solution

The etching treatment for the aluminum plate was performed by spraying an aqueous solution containing 370 g/L of NaOH and 100 g/L of aluminum ions at 60° C. on the aluminum plate with a spray tube. An amount of dissolution on the surface of the aluminum plate subject to the electrochemical surface roughening treatment in the subsequent step was 3 g/m$^2$.

Thereafter, the solution was drained off with a nip roller, then the plate was subjected to water washing, and then the water was drained off with the nip roller. This water washing treatment was performed by use of an apparatus configured to perform a water washing treatment with a liquid film of a free-fall curtain shape. Thereafter, the plate was washed for 5 seconds with water splashing in a fan shape out of a spray tip which was fitted to the spray tube.

<2> Desmutting in Acidic Aqueous Solution

Next, the desmutting treatment was performed.

A nitric acid waste fluid used in the subsequent electrochemical surface roughening treatment was used herein. The fluid temperature was 35° C. The desmutting treatment was performed by spraying the desmutting solution for 5 seconds with a spray. Thereafter, the solution was not drained off with the nip roller. Instead, the aluminum plate was handled to the next step while leaving nitric acid attached thereto. After passing through the desmutting tank, the handling time while leaving nitric acid attached to the plate accounted for 25 seconds.

<3> Electrochemical Surface Roughening Treatment in Nitric Acid Aqueous Solution An electrolytic solution was prepared by adding aluminum nitrate to an aqueous solution having the nitric acid concentration of 10.4 g/L at the fluid temperature of 35° C., and thereby controlling the aluminum ion concentration to 4.5 g/L.

An electrolytic solution having the same compositions and the same temperature as the nitric acid electrolytic solution used in the electrochemical surface roughening treatment was sprayed on the aluminum plate immediately before starting the electrochemical surface roughening treatment.

The electrochemical surface roughening treatment was performed by use of a power source generating an alternating current. The frequency of the alternating current was 60 Hz, and the time Tp consumed by the current to reach from 0 to a peak was 1.2 msec. The duty of the alternating current (ta/T) was 0.5.

The current density at the peak of the alternate current was 60 A/dm$^2$ at the anodic reaction of the aluminum plate. A ratio between the total quantity of electricity at the anodic reaction of the aluminum plate and the total quantity of electricity at the cathodic reaction thereof was 0.95. The quantity of electricity applied to the aluminum plate was 215 C/dm$^2$ in terms of the total quantity of electricity at the anodic reaction of the aluminum plate.

Two radial-type tanks shown in FIG. 3 were used as the electrolytic tanks. A relative velocity between the aluminum plate and the electrolytic solution was 1.5 m/sec (1 to 2 m/sec) on an average inside the electrolytic tanks.

Subsequently, the solution was drained off with the nip roller, and the plate was subjected to water washing. Thereafter, the plate was washed for 5 seconds with water splashing in a fan shape out of the spray tip which was fitted to the spray tube. Then, the water was drained off with the nip roller.

<4> Etching Treatment in Alkaline Aqueous Solution

The etching treatment for the aluminum plate was performed by spraying an aqueous solution containing 370 g/L of NaOH and 100 g/L of aluminum ions at 64° C. on the aluminum plate for 7 seconds with the spray tube. An amount of dissolution on the surface of the aluminum plate to be subjected to the electrochemical surface roughening treatment in the subsequent step was 3 g/m$^2$.

Thereafter, the solution was drained off with the nip roller, then the plate was subjected to water washing, and then the water was drained off with the nip roller. This water washing treatment was performed by use of the apparatus configured to perform the water washing treatment with a liquid film of a free-fall curtain shape. Thereafter, the plate was washed for 5 seconds with water splashing in a fan shape out of the spray tip which was fitted to the spray tube. Then, the water was drained off with the nip roller.

<5> Desmutting in Acidic Aqueous Solution

Next, the desmutting treatment was performed. A solution was prepared by dissolving 2 g/L of aluminum ions in an aqueous solution having the sulfuric acid concentration of 300 g/L. The desmutting treatment was performed for 10 seconds at the fluid temperature of 35° C.

Subsequently, the solution was drained off with the nip roller, and the plate was washed for 5 seconds with water splashing in a fan shape out of the spray tip which was fitted to the spray tube. Then, the water was drained off with the nip roller.

<6> Electrochemical Surface Roughening Treatment in Hydrochloric Aqueous Solution An electrolytic solution was prepared by adding aluminum chloride to an aqueous solution having the hydrochloric acid concentration of 5 g/L at the fluid temperature of 35° C., and thereby controlling the aluminum ion concentration to 5 g/L.

The electrochemical surface roughening treatment was performed by use of a power source generating an alternating current of a trapezoidal waveform. The frequency of the alternating current was 60 Hz, and the time Tp consumed by the current to reach from 0 to a peak was 0.8. The duty of the alternating current (ta/T) was 0.5.

The current density at the peak of the alternating current was 50 A/dm$^2$ at the anodic reaction of the aluminum plate. A ratio between the total quantity of electricity at the anodic reaction of the aluminum plate and the total quantity of electricity at the cathodic reaction thereof was 0.95. The quantity of electricity applied to the aluminum plate was 65 C/dm$^2$ in terms of the total quantity of electricity at the anodic reaction of the aluminum plate.

One radial-type tank shown in FIG. 3 was used as the electrolytic tank.

A relative velocity between the aluminum plate and the electrolytic solution was 1.5 m/sec on an average inside the electrolytic tank. Subsequently, the solution was drained off with the nip roller, and the plate was subjected to water washing. Then, the water was drained off with the nip roller.

<7> Etching Treatment in Alkaline Aqueous Solution

The etching treatment for the aluminum plate was performed by spraying an aqueous solution containing 50 g/L of NaOH and 5 g/L of aluminum ions at 35° C. on the aluminum plate so as to dissolve the aluminum plate at a rate of 0.2 g/m$^2$.

Thereafter, the solution was drained off with the nip roller, then the plate was subjected to water washing, and then the water was drained off with the nip roller.

This water washing treatment was performed by use of the apparatus configured to perform the water washing treatment with a liquid film of a free-fall curtain shape. Thereafter, the plate was washed for 5 seconds with water splashing in a fan shape out of the spray tip which was fitted to the spray tube. Then, the water was drained off with the nip roller.

<8> Desmutting Treatment in Acidic Aqueous Solution

Next, the desmutting treatment was performed. A waste fluid generated in the subsequent anodic oxidation treatment (5 g/L of aluminum ions dissolved in an aqueous solution having the sulfuric acid concentration of 170 g/L) was used as the acidic aqueous solution for the desmutting treatment. The desmutting treatment was performed for 5 seconds at the fluid temperature of 35° C.

Thereafter, the solution was drained off with the nip roller. After draining, no water washing treatment was performed until the anodic oxidation.

<9> Anodic Oxidation Treatment

Next, this plate was subjected to the anodic oxidation treatment under the following conditions.

An electrolytic solution was prepared by adding aluminum sulfate to a solution having the sulfuric acid concentration of 170 g/L so as to adjust the aluminum ion concentration to 5 g/L while setting the fluid temperature at 33° C. Using this solution, a direct current anodic oxidation film in an amount of 2.4 g/m$^2$ was provided under a condition of setting the current density applied to the aluminum plate in the electrolytic tank to be equal to 15 A/dm$^2$ in terms of the average current density during the anodic reaction of the aluminum plate.

<10> Hydrophilic Treatment

The hydrophilic treatment was performed by dipping the plate in an aqueous solution containing 2.5% of sodium silicate at 20° C. for 10 seconds. A Si amount on the surface of this aluminum plate was measured by use of an x-ray fluorescence analyzer, and the Si amount was 3.5 mg/m$^2$. Thereafter, the solution was drained off with the nip roller and the plate was subjected to water washing. Then, the water was drained off with the nip roller.

Subsequently, the plate was dried by blowing air at 90° C. for 10 minutes.

When the surface shapes of these aluminum plates were observed by use of a scanning electron microscope at 50000× magnification, fine irregularities having diameters of 0.1 μm were formed uniformly and densely on the surfaces. When the surface shapes were observed by use of the scanning electron microscope at 2000× magnification, irregularities having diameters of 1 to 5 μm were formed on the surfaces of the aluminum plates. The fine irregularities having the diameters of 0.1 μm were formed on the irregularities having the diameters of 1 to 5 μm in an overlapping fashion.

4. Fabrication of Presensitized Plate

The respective supports for lithographic printing plates (Supports 1-1-1, 2-1-1, 3-1-1, and 5-1-1) obtained in the above-described processes were coated with the image recording layers of the thermal positive type and dried under the following conditions. In this way, the presensitized plates (Presensitized Plates 1-1-1-1, 2-1-1-1, 3-1-1-1, and 5-1-1-1) were fabricated. The presensitized plates were then used for printing. Here, the undercoating layer was provided as described below before providing the image recording layer (the image recording layer thus obtained will be referred to as Image Recording Layer 1). The presensitized plate is represented by the combination abbreviation numbers of the "roll—rolling process—surface treatment—image recording layer".

The lithographic printing plates thus obtained were favorable printing plates having excellent printing performances in light of the sensitivity, the number of printed sheets (the press life), the stain resistance, and the ink spread resistance.

Each support for a lithographic printing plate was coated with an undercoating solution having the following composition, after which drying at 80° C. for 15 seconds was performed to form the undercoating layer film. An amount of the coating film after drying was 15 mg/m$^2$.

Composition of Undercoating Solution

Polymer Expressed by the Following Chemical Formula 0.3 g

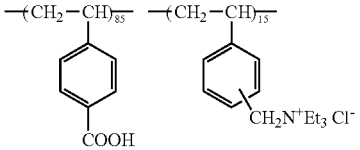

MOLECULAR WEIGHT 28 THOUSANDS

| | |
|---|---|
| * methanol | 100 g |
| * water | 1 g |

Further, a heat-sensitive layer coating solution of the following composition was prepared. The support for a lithographic printing plate provided with the undercoating layer was coated with this heat-sensitive coating solution so that the amount of the heat-sensitive layer coating solution (used to form a the heat-sensitive layer) was 1.8 g/m$^2$ after drying. The heat-sensitive layer (the image recording layer of the thermal positive type) was formed by drying, and the presensitized plate was thereby obtained.

| <Composition of heat-sensitive layer coating solution> | |
|---|---|
| *novolac resin (m-cresol: p-cresol = 60:40, weight-average molecular weight 7000, 0.05 wt % unreacted cresol contained) | 0.90 g |
| *ethyl metacrylate - isobutyl methacrylate - methacrylic acid copolymer (mole ratio 35:35:30) | 0.10 g |
| *a cyanine dye A expressed by the following structural formula | 0.1 g |

CYANINE DYE A

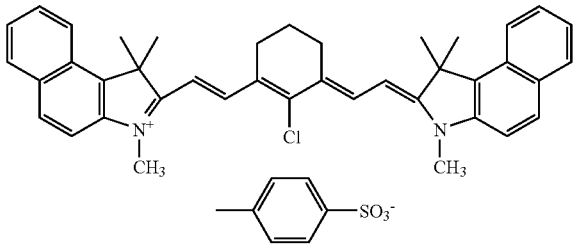

| | |
|---|---|
| *tetrahydrophthalic anhydride | 0.05 g |
| *p-toluene sulfonic acid | 0.002 g |
| *ethyl violet modified by replacing a counter ion with 6-hydroxy-β-naphthalene sulfonic acid | 0.02 g |
| *a fluorine-based surfactant (Defensa F-780F, made by Dainippon Ink and Chemicals Incorporated, solid content 30 wt %) (in solid content) | 0.0045 g |
| *a fluorine-based surfactant (Defensa F-781F, made by Dainippon Ink and Chemicals Incorporated, solid content 100 wt %) | 0.0035 g |
| *methylethylketone | 12 g |

Example 6

Using different pieces of the processed aluminum plates 1-1, 2-1, and 3-1 provided with the irregularities, the sealing treatment <11> in which the aluminum plates were dipped in a solution which contains 0.2 wt % of sodium fluorozirconate and 0.2 wt % of sodium dihydrogen phosphate and has the fluid temperature of 70° C., was performed for 10 seconds after the anodic oxidation treatment <9> described in Example 5. The solution was drained off with the nip roller. Then, the plates were subjected to water washing. Subsequently, the water was drained off with the nip roller.

Thereafter, the hydrophilic treatment <10> described in Example 5 was performed. Subsequently, the plates were dried by blowing air at 90° C. for 10 seconds (the above-described surface treatment will be abbreviated as Surface Treatment 2). In this way, the supports for lithographic printing plates 1-1-2, 2-1-2, and 3-1-2 were obtained.

The respective aluminum plates were coated with the photosensitive layers similar to those in Example 5 and dried. In this way, the presensitized plates (Presensitized Plates 1-1-2-1, 2-1-2-1, and 3-1-2-1) were fabricated. The presensitized plates were then used for printing. The lithographic printing plates thus obtained were favorable printing plates having printing performances in light of the number of printed sheets (the press life), the stain resistance, and the ink spread resistance as excellent as those of the printing plates obtained in Example 5. However, the printing plates fabricated in this example exhibited better development property (the sensitivity) than the presensitized plates (Presensitized Plates 1-1-1-1, 2-1-1-1, and 3-1-1-1) fabricated in Example 5.

Example 7

Using different pieces of the processed aluminum plates 1-1, 2-1, and 3-1 provided with the irregularities, the sealing treatment <12> in which the aluminum plates were dipped in a solution which contains 0.1 wt % of sodium fluorozirconate and 0.1 wt % of sodium dihydrogen phosphate and has the fluid temperature of 45° C., was performed for 10 seconds after the anodic oxidation treatment <9> described in Example 5. The solution was drained off with the nip roller. Then, the plates were subjected to water washing. Subsequently, the water was drained off with the nip roller.

Thereafter, the hydrophilic treatment <10> described in Example 5 was performed. Subsequently, the plates were dried by blowing air at 90° C. for 10 seconds (the above-described surface treatment will be abbreviated as Surface Treatment 3). In this way, the supports for lithographic printing plates 1-1-3, 2-1-3, and 3-1-3 were obtained.

The respective aluminum plates were coated with the photosensitive layers used in Example 5 and dried. In this way, the presensitized plates (Presensitized Plates 1-1-3-1, 2-1-3-1, and 3-1-3-1) were fabricated. The presensitized plates were then used for printing. The lithographic printing plates thus obtained were favorable printing plates having printing performances in light of the number of printed sheets, the stain resistance, and the ink spread resistance as excellent as those of the printing plates obtained in Example 5. However, the printing plates fabricated in this example exhibited better development property (the sensitivity) than the presensitized plates (Presensitized Plates 1-1-1-1, 2-1-1-1, and 3-1-1-1) fabricated in Example 5.

Example 8

Using a different piece of the processed aluminum plate 5-1 provided with the irregularities, the sealing treatment in which the aluminum plate was dipped in a solution which contains 1 wt % of sodium dihydrogen phosphate and 0.1 wt % of sodium fluorozirconate and has the fluid temperature of 40° C., was performed for 10 seconds after the anodic oxidation treatment <9> described in Example 5. The solution was drained off with the nip roller. Then, the plate was subjected to water washing. Subsequently, the water was drained off with the nip roller.

Thereafter, the hydrophilic treatment <10> described in Example 5 was performed. Subsequently, the plate was dried by blowing air at 90° C. for 10 seconds (the above-described surface treatment will be abbreviated as Surface Treatment 4).

This aluminum support 5-1-4 was coated with the photosensitive layer as used in Example 5 and dried. In this way, the presensitized plate (Presensitized Plate 5-1-4-1) was fabricated. The presensitized plate was then used for printing. The lithographic printing plate thus obtained was a favorable printing plate having printing performances in light of the number of printed sheets (the press life), the stain resistance, and the ink spread resistance as excellent as those of the printing plate obtained in Example 5. However, the printing plate fabricated in this example exhibited better development property (the sensitivity) than the presensitized plate (Presensitized Plate 5-1-1-1) fabricated in Example 5.

Example 9

The aluminum plates were provided with the irregularities in the same manner as Example 5, except that Rolls 4 and 6 obtained in Examples 4-1 and 4-3 were used instead. Then the aluminum plates were subjected to the surface roughening treatment and coated with the photosensitive layers, and were thereby formed into the presensitized plates (Presensitized Plates 4-1-1-1 and 6-1-1-1). These presensitized plates were then used for printing. The printing plates thus obtained were favorable lithographic printing plates having printing performances as excellent as those of the printing plate using Presensitized Plate 5-1-1-1 obtained in Example 5.

Example 10

The roll for metal rolling (Roll 7) was fabricated as in Example 4-2, except that the buffing treatment in Example 4 was not performed. Thereafter, the aluminum plate was provided with the irregularities as in Example 5 by using this roll. The aluminum plate was subjected to the subsequent surface roughening treatment and was thereby formed into Support 7-1-1. The support was coated with a photosensitive layer, and was formed into the presensitized plate (Presensitized Plate 7-1-1-1). This presensitized plate was subjected to exposure and development, and was thereby formed into the printing plate. Then, the printing plate was used for printing. The printing plate thus obtained was a favorable printing plate having printing performances in light of the stain resistance and the ink spread resistance as excellent as those of the printing plate using Presensitized Plate 5-1-1-1 obtained in Example 5. However, the development property and the number of printed sheets of this printing plate were inferior to the performances of the printing plate using Presensitized Plate 5-1-1-1 obtained in Example 5.

Comparative Example 1

A roll for metal rolling was formed according to the air blast method using alumina having an average grain size of 150 μm as a grid material. The roll was subjected to surface roughening by pelting the grids twice. After the Ra of the roll reached 1.0 μm, the surface was polished again to adjust the Ra to 0.8 μm. Then, the roll was subjected to hard chromium plating in the thickness of 7 μm as in Example 1. In this way, the Ra of the roll reached 0.7 μm. Using this roll for metal rolling (Roll C1), the aluminum plate as in Example 5-1 was provided with the irregularities. Moreover, the aluminum plate was subjected to the surface roughening treatment as in Support 5-1-5 obtained in Example 5, coated with the photosensitive layer used in Example 5, and was fabricated into the presensitized plate (Comparative Presensitized Plate C1-1-1-1). This presensitized plate was subjected to exposure and development as in Example 5 and was thereby formed into the printing plate. This printing plate was then used for printing.

This printing plate exhibited printing performances in light of the stain resistance and the ink spread resistance as excellent as those in Example 5 (Presensitized Plates 1-1-1-1, 2-1-1-1, and 3-1-1-1), Example 6 (Presensitized Plates 1-1-2-1, 2-1-2-1, and 3-1-2-1), and Example 7 (Presensitized Plates 1-1-3-1, 2-1-3-1, and 3-1-3-1). However, the development property and the number of printed sheets of this printing plate were inferior to the performances of the printing plates obtained in Examples 5, 6, and 7.

Comparative Example 2

A roll for metal rolling was formed according to the air blast method using #128 mesh alumina as a grid material. The roll was subjected to surface roughening by pelting the grids twice. After the Ra of the roll reached 1.7 μm, the surface was polished again to adjust the Ra to 1.3 μm. Then, the roll was subjected to hard chromium plating in the thickness of 6 μm as in Example 4. Using this roll for metal rolling (abbreviated as Roll C2), the aluminum plate was provided with the irregularities (abbreviated as Processed Plate C2-1). Concerning this aluminum plate, the Ra was 1.2 μm, the Rmax was 15 μm, the Sm was 90 μm, and the Δa was 8 degrees.

Moreover, the aluminum plate was subjected to the surface roughening treatment as in Example 5, coated with the photosensitive layer, and was fabricated into the presensitized plate. This presensitized plate (C2-1-1-1) was subjected to exposure and development as in Example 5 and was thereby formed into the printing plate. This printing plate was then used for printing.

This printing plate exhibited printing performances in light of the stain resistance and the ink spread resistance as excellent as those of Presensitized Plate 5-1-1-1 obtained in Example 5. However, the development property and the number of printed sheets of this printing plate were inferior to the performances of Presensitized Plate 5-1-1-1 obtained in Example 5.

4. Evaluation of Presensitized Plate

The press life and the stain resistance of the lithographic printing plates were evaluated in accordance with the following methods.

(1) Press Life (the Number of Printed Sheets)

An image was drawn into the obtained presensitized plate by use of TrendSetter made by Creo while setting drum revolution at 150 rpm and beam intensity at 10 W.

Thereafter, the presensitized plate was developed for 20 seconds by PS Processor 940H made by Fuji Photo Film Co., Ltd. containing an alkaline developer having the following composition while maintaining the developer at 30° C. The lithographic printing plate was obtained accordingly.

| <Composition of alkaline developer B> | |
|---|---|
| D-sorbit | 2.5 wt % |
| sodium hydroxide | 0.85 wt % |
| polyethyleneglycol lauryl ether (weight-average molecular weight 1000) | 0.5 wt % |
| water | 96.15 wt % |

The obtained lithographic printing plate was set on Lithrone Press (made by Komori Corporation) for printing by use of black ink DIC-GEOS (N) made by Dainippon Ink and Chemicals Incorporated. Press life was evaluated by the number of printed sheets at the time of visual detection of the start of solid image fading. Results are shown in Table 4.

A: The number of printed sheets is 40000 or above

B: The number of printed sheets is 30000 or above but less than 40000

C: The number of printed sheets is 20000 or above but less than 30000

D: The number of printed sheets is less than 20000

(2) Sensitivity

The presensitized plate was exposed by use of TrendSetter made by Creo equipped with a semiconductor laser having the output power of 500 mW, the wavelength of 830 nm, and the beam diameter of 17 μm ($1/e^2$) and under the conditions of the main scanning speed of 5 m/sec and the plate surface energy quantity of 140 mJ/cm$^2$. For the purpose of evaluation of the sensitivity, several samples were prepared by exposing the sensitized plate with the plate surface energy quantities in a range of 45 to 180 mJ/cm$^2$ while varying the quantities by 5 mJ/cm$^2$ pitches.

The development was performed by use of Automatic Processor PS900NP (made by Fuji Photo Film Co., Ltd.) filled with the developer B and under the conditions of the development temperature of 25° C., and the time of 12 seconds. After completion of the development, the plate was subjected to water washing and processed with gum (GU-7 (1:1)) and the like. In this way, the plate making was completed and the lithographic printing plate was obtained. The sensitivity was measured by determining the smallest exposure amount with which image could be formed after the development while using the samples having the various plate surface energy quantities.

Results are shown in Table 4. In Table 4, the following criteria were used for evaluation.

A: Energy quantity less than 50 mJ/cm$^2$

B: Energy quantity 50 mJ/cm$^2$ or above but less than 100 mJ/cm$^2$

C: Energy quantity 100 mJ/cm$^2$ or above but less than 150 mJ/cm$^2$

D: Energy quantity 150 mJ/cm$^2$ or above (3) Stain Resistance

The lithographic printing plate as obtained in the above-described evaluation of (1) Press life was set on Mitsubishi DAIYA F2 Press (made by Mitsubishi Heavy Industries, Ltd.) for printing by use of red ink DIC-GEOS (s). After printing 10000 sheets, stains on a blanket were evaluated visually.

Results are shown in Table 4. In Table 4, the following criteria were used for evaluation.

A: very few stains on the blanket

B: a few stains on the blanket

B-C: the blanket is stained but is still acceptable

C: the blanket is stained and a printed sheet is apparently stained (4) Ink Spread Resistance Depending on the ink type, when a fountain solution is reduced, ink spreading at a shadow part (halftone dots having high image-area rates), that is, adhesion of the ink to a non-image portion (such a phenomenon will be hereinafter referred to as "ink spreading", and resistance to occurrence of such ink spreading will be referred to as "ink spread resistance") may occur. The lithographic printing plate as obtained in the above-described evaluation of (1) Press life was set on SOR-M Press made by Heidelberg for printing. Here, black ink DIC-GEOS (H) made by Dainippon Ink and Chemicals Incoroprated was used to reduce a fountain solution. In this way, degrees of ink spreading in halftone dots were evaluated by three grades. Results are shown in Table 4. Evaluation was based on the following criteria.

A: Excellent ink spread resistance

A-B: A little ink spreading observed

B: Ink spreading observed

TABLE 4

Evaluation of presensitized plates

| Presensitized plate | Al composition | Roll for transferring irregularities | Processes for manufacturing support | Sensitivity | Press life | Stain resistance | Ink spread resistance |
|---|---|---|---|---|---|---|---|
| Example 5 1-1-1-1 | Table 2 | Electrolytically surface roughed roll of Example 1 | <1>~<10> | B | A | A | A |
| Example 5 2-1-1-1 | Table 2 | Electrolytically surface roughed roll of Example 2 | <1>~<10> | B | A | A | A |
| Example 5 3-1-1-1 | Table 2 | Electrolytically surface roughed roll of Example 3 | <1>~<10> | B | A | A | A |
| Example 5 5-1-1-1 | Table 2 | Electrolytically surface roughed roll of Example 4-2 | <1>~<10> | B | A | A | A |
| Example 6 1-1-2-1 | Table 2 | Electrolytically surface roughed roll of Example 1 | <1>~<10>, <11> sealing treatment inserted between <9> and <10> | A | A | A | A |
| Example 6 2-1-2-1 | Table 2 | Electrolytically surface roughed roll of Example 2 | <1>~<10>, <11> sealing treatment inserted between <9> and <10> | A | A | A | A |
| Example 6 3-1-2-1 | Table 2 | Electrolytically surface roughed roll of Example 3 | <1>~<10>, <11> sealing treatment inserted between <9> and <10> | A | A | A | A |
| Example 7 1-1-3-1 | Table 2 | Electrolytically surface roughed roll of Example 1 | <1>~<10>, <12> sealing treatment inserted between <9> and <10> | A | A | A | A |
| Example 7 2-1-3-1 | Table 2 | Electrolytically surface roughed roll of Example 2 | <1>~<10>, <12> sealing treatment inserted between <9> and <10> | A | A | A | A |
| Example 7 3-1-3-1 | Table 2 | Electrolytically surface roughed roll of Example 3 | <1>~<10>, <12> sealing treatment inserted between <9> and <10> | A | A | A | A |
| Example 8 5-1-4-1 | Table 2 | Electrolytically surface roughed roll of Example 4-2 | <1>~<10>, <13> sealing treatment inserted between <9> and <10> | A | A | A | A |
| Example 9 4-1-1-1 | Table 2 | Electrolytically surface roughed roll of Example 4-1 | <1>~<10> | B | A | A | A |
| Example 9 6-3-1-1 | Table 2 | Electrolytically surface roughed roll of Example 4-3 | <1>~<10> | B | A | A | A |
| Example 10 7-1-1-1 | Table 2 | Roll of Example 4-2 without buffing | <1>~<10> | B–C | B | A | A |
| Comparative Example 1 C1-1-1-1 | Table 2 | Surface roughened roll by air blasting | <1>~<10> | C | C | B | A |
| Comparative Example 1 C2-1-1-1 | Table 2 | Surface roughened roll by air blasting | <1>~<10> | C | C | A | B |

What is claimed is:

1. A method of manufacturing an aluminum support for a lithographic printing plate, comprising:

transferring irregularities onto a surface of an aluminum plate by use of a roll for metal rolling; and electrochemically roughening the surface and anodizing the surface, wherein said roll for metal rolling comprises:

a roughened surface having an average surface roughness Ra of 0.5-2.0 μm formed on a surface of a steel roll by an electrolytic treatment in an electrolytic solution while using the roll as an anode; and a chromium-plated layer having an average surface roughness Ra of 0.5-2.0 μm formed on the roughened surface.

2. The method according to claim 1, wherein said electrolytic solution of the electrolytic treatment of the steel roll is an aqueous solution of at least one acid selected from the group consisting of nitric acid, hydrochloric acid, sulfuric acid, and phosphoric acid.

3. The method according to claim 1, wherein said electrolytic solution of the electrolytic treatment of the steel roll is an aqueous solution at least including chromic acid.

4. The method according to claim 1, wherein the surface of the steel roll is subjected to a mirror surface polishing treatment in advance.

5. The method according to claim 1, wherein the surface of the roll after the electrolytic treatment has an average surface roughness Ra in a range of 0.5 to 2 μm and an average interval of irregularities Sm in a range of 10 to 200 μm.

6. The method according to claim 1, wherein the average surface roughness Ra on the surface of the steel roll before performing the electrolytic treatment in the electrolytic solution while using the roll as the anode is in a range of 0.01 to 0.3 μm.

7. The method according to claim 1, further comprising chemically etching the aluminum surface.

8. A support for a lithographic printing plate obtained by the method according to claim 1.

* * * * *